US006607995B1

(12) United States Patent
Takeuchi et al.

(10) Patent No.: US 6,607,995 B1
(45) Date of Patent: Aug. 19, 2003

(54) LINING CLOTH AND METHOD FOR PRODUCING THE SAME

(75) Inventors: Hisaharu Takeuchi, Hirakata (JP); Tsuneo Igarashi, Moriyama (JP); Hiroyuki Mizuki, Kanazawa (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 09/581,635

(22) PCT Filed: Dec. 17, 1998

(86) PCT No.: PCT/JP98/05726

§ 371 (c)(1),
(2), (4) Date: Jun. 15, 2000

(87) PCT Pub. No.: WO99/31309

PCT Pub. Date: Jun. 24, 1999

(30) Foreign Application Priority Data

Dec. 17, 1997 (JP) ..... 9-363766
Oct. 14, 1998 (JP) ..... 10-292385

(51) Int. Cl.[7] ..... D03D 15/00

(52) U.S. Cl. ..... 442/216; 442/203; 442/208; 442/213; 442/214; 442/301

(58) Field of Search ..... 442/203, 208, 442/213, 214, 216, 301

(56) References Cited

U.S. PATENT DOCUMENTS 6,284,370 B1 * 9/2001 Fujimoto et al. ..... 428/364

FOREIGN PATENT DOCUMENTS

| | | |
|---|---|---|
| JP | 53-130363 | 11/1978 |
| JP | 58-115144 | 7/1983 |
| JP | 1-21261 | 4/1989 |
| JP | 2-191702 | 7/1990 |
| JP | 3-152236 | 6/1991 |
| JP | 6-65854 | 3/1994 |
| JP | 6-73634 | 3/1994 |
| JP | 7-78283 | 8/1995 |
| JP | 8-158197 | 6/1996 |

* cited by examiner

*Primary Examiner*—Elizabeth M. Cole
*Assistant Examiner*—Norca L. Torres
(74) *Attorney, Agent, or Firm*—Finnegan, Henderson, Farabow, Garrett & Dunner, L.L.P.

(57) ABSTRACT

A lining cloth of a woven fabric in which the warp yarn comprises either of polyester filamentary yarn or cellulosic filamentary yarn and the filling yarn comprises either a false-twisted polyester filamentary yarn, a raw filamentary yarn or a cellulosic filamentary yarn, characterized in that an elongation in the filling-wise direction of the woven fabric is in a range from 5% to 12%, a coefficient of dynamic friction on the surface of the woven fabric is in a range from 0.20 to 0.45, and a filling-wise crimp index value of the woven fabric as defined by the following formula (1) is in a range from 0.003 to 0.013:

$$\text{Crimp ratio of the filling yarn}/\{\text{warp density}\times(\text{warp fineness})^{1/2}\} \quad (1)$$

The lining cloth according to the present invention is soft in touch, excellent in slipperiness, resistant to seam slippage and free from wearing pressure. The lining cloth is suitably used as a lining for a skirt which is otherwise liable to ride up.

The lining cloth according to the present invention is produced by heat-treating a grey fabric woven from warp yarns of polyester filament or cellulosic filament and filling yarns of raw polyester filament at a temperature in a range from 160° C. to 210° C. prior to or after the scouring while being narrowed in width by 5 to 30% relative to the grey fabric.

12 Claims, No Drawings

LINING CLOTH AND METHOD FOR PRODUCING THE SAME

TECHNICAL FIELD

The present invention relates to a lining cloth having a reduced seam slippage and giving a wearer a less constrained feeling and, specifically, to a slippery lining cloth stretchable in the filling-wise (weft-wise) direction, is soft in touch and excellent in surface smoothness, and which is woven from 100% polyester filamentary yarns or mixture of cellulosic filamentary yarns and polyester filamentary yarns or 100% cellulosic filamentary yarns.

BACKGROUND ART

Nowadays, fibrous materials used for a woven lining cloth are roughly classified into a polyester filament type and a cellulosic filament type. The lining cloth composed of 100% polyester filamentary yarns occupies a share of nearly to 80% in a Japanese market for lining cloth because of the reasonable cost, high mechanical strength such as a tensile strength, bending strength or resistance to wear, excellent laundry dimensional stability and a smaller change in the appearance thereof in comparison with that composed of 100% cellulosic filament yarn. The lining cloth composed of 100% cellulosic filament yarns is excellent in moisture absorption, sweat absorption, antistatic property and slipperiness which are not obtainable from the polyester filament type lining cloth, and has a good reputation particularly in a field of high-class female dress.

On the other hand, for the purpose of combining merits of the polyester filament and those of the cellulosic filament with each other, a lining cloth mixedly woven from these filamentary yarns has been marketed.

Recently, outer cloths used for, dresses have become soft and pliable reflecting a fashion trend to regard wearing comfort of clothes and the silhouette as important. Also, a soft and pliable lining cloth is in demand and has been marketed this cloth enhances the wearing comfort and does not affect the silhouette of the outer cloth.

As means for obtaining such a soft and pliable lining cloth, reducing the warp/filling density of a woven fabric, using a smaller denier filament yarns, improving dyeing or finishing process or other methods have been adopted. Particularly in a lining cloth composed of 100% polyester filament yarns, however, a concentrated sodium hydroxide solution is used in most of the dyeing and finishing process for the purpose of weight reduction to give a soft touch. Among the lining cloths obtained through the weight reduction treatment, highly weight-reduced products of a reduction ratio in a range from about 10 to 20% are extremely soft and bulky in touch, and have been favorably used as a high-class lining cloth.

Softening of touch due to the weight reduction treatment is a method for thinning polyester filaments through hydrolization with an alkali solution. Therefore, a gap is created between warp yarns and filling yarns forming the woven fabric as well as between multi-filaments composing the respective warp yarn and the respective filling yarn of the woven fabric. The improvement in softness and bulkiness in touch of the woven fabric is necessarily accompanied with the reduction in tensile rigidity, bending rigidity or shearing rigidity of the woven fabric. Although such a highly weight-reduced lining cloth is soft in touch, it has a drawback in that warp yarns and filling yarns composing the cloth is easily mobile when a large tensile or shearing force is applied thereto, for example, during the wear thereof. This causes a practical problem in that seam slippage is liable to occur when this cloth is worn as a dress. In this respect, "seam slippage" is referred to as a phenomenon in that warp yarns or filling yarns slip out of place about the seam when a stress is applied to the seam of the woven fabric and causing bursting of seam in an extreme case.

A typical example of dresses wherein the seam slippage is actually liable to occur is a tight skirt for a female. In the tight skirt, a "kise (phonetic)" (fullness work) hardly exists in a sewn lining cloth for a tight skirt for the purpose of obtaining a good touch whereby there is little room in the lining cloth for a body dimension. Also, since the tight skirt is subjected to a relatively large motion during walking or sitting, the seam tends to stretch and slip off. A countermeasure against the seam slippage is an increase in density of warp/filling yarns and an increase in the coefficient of interfiber friction by the use of an anti-slip agent. However, the increase in density of warp/filling yarns deteriorates the softness of touch, and the effect of the anti-slip agent is not permanent but temporary, which disappears when the cloth is rinsed.

The present inventors have carried out various analysis of hundreds of outer cloths and typical lining cloths now on market for the purpose of providing lining cloths soft in touch and excellent in anti-seam slippage performance to discover why the conventional lining cloth used for a skirt is liable to generate seam-slippage, and have obtained the following knowledge:

According to the measurement of a filling-wise elongation of a woven fabric composing the outer cloth and the lining cloth, respectively, at a tensile stress of 500 g/cm, it has been found that most of the outer cloths have an elongation of approximately 10%, while that of the lining cloths is at most approximately 3%. From this, it is apparent that if a dress wherein the outer cloth is lined with the lining cloth is stretched to some extent, a stress generated in the outer cloth is small, but a stress in the lining cloth is much larger. In this regard, the weakest region, against a stress generated in the lining cloth, is a seam, whereby it is suggested that the seam slippage would occur when the cloth is stretched.

For example, since the lining cloth in a hip portion of the skirt is sewn in the warp-wise direction of the outer cloth, the slippage of a warp-wise seam occurs due to a filling-wise stress. Particularly, since yarns are easily mobile in the weave structure in a lining cloth which has been subjected to a weight reduction treatment with alkaline for the purpose of softening a touch thereof, the seam slippage would be significant.

Accordingly, it is deemed that if the lining cloth has a filling-wise elongation equal to that of the outer cloth, the seam slippage and deterioration of the silhouette of the outer cloth do not occur.

The design of a filling-wise elongation of the conventional lining cloth is deemed erroneous because there is a mis-match in a stress between the lining cloth and the outer cloth, which would be apparent from a fact in that, when the wearer of a short tight skirt sits down on a chair or a seat of a train, the skirt is abnormally dragged up.

Examples of a woven fabric composed of 100% polyester yarns are disclosed, for instance, in Japanese Unexamined Patent Publication (Kokai) No. 53-130363 and Japanese Examined Patent Publication (Kokoku) Nos. 58-115144 and 1-21261, wherein false-twisted yarns are used as filling yarns so that a filling-wise elongation of 15% or more is obtained. A woven fabric disclosed in Japanese Unexamined Patent Publication (Kokai) No. 53-130363 uses false-twisted yarns produced under specially defined conditions so that a rough surface texture is mitigated while achieving a high elongation of 15% or more. However, this fabric has a surface irregularity due to the false-twisted filling yarns having a significant bending configuration which bulge out of the fabric surface rather than warp yarns, whereby the fabric has a rough touch and a large bulkiness while it lacks the slipperiness necessary for the lining cloth. Thus, this fabric is low in dressing convenience and in wearing comfort.

Japanese Examined Patent Publication (Kokoku) No. 1-21261 relates to a finishing method for a woven fabric for obtaining a filling-wise elongation of 15% or more. However, the resultant fabric is also unsuitable for a lining cloth because of its rough touch.

Japanese Examined Patent Publication (Kokoku) No. 58-115144 relates to a woven fabric having an elongation of 15% or more both in the warp-wise and filling-wise directions as well as a rough surface texture. While, Japanese Examined Patent Publication (Kokoku) No. 7-78283 proposes a lining cloth having a favorable pliability (soft and bulky touch) and slipperiness while using raw polyester filament as filling yarns. The lining cloth has a filling-wise elongation of 4% or less which suggests that this lining cloth would have no effect an preventing the seam from slipping or mitigating a constrained feel as apparent from the above-mentioned knowledge.

As described hereinabove, there are no lining cloths of a woven fabric in the prior art having a suitable elongation in the filling-wise direction made by using raw polyester filamentary yarns or cellulosic filamentary yarns as filling yarns.

DISCLOSURE OF THE INVENTION

An object of the present invention is to provide a lining cloth composed of filamentary yarns, having the improved functions necessary for a lining cloth; excellent in softness, slipperiness, good touch; and not giving a wearer a constrained feeling.

Another object of the present invention is to provide a lining cloth having the above-mentioned improved functions necessary for-a lining cloth composed of 100% polyester filamentary yarns, composed of mixedly woven polyester filamentary yarns and cellulosic filamentary yarns, and composed of 100% cellulosic filamentary yarns.

Further important object of the present invention is to provide a method for producing a lining cloth having the above-mentioned improved functions necessary for the lining cloth, obtained from a woven fabric of filamentary yarns including that of 100% polyester filamentary yarns, of mixedly woven polyester filamentary yarns and cellulosic filamentary yarns and of 100% cellulosic filamentary yarns.

The present inventors have made the invention based on the above-mentioned knowledge in that the filling-wise elongation of the woven fabric composed of the lining cloth is largely related to the performance of the lining cloth and, therefore, by suitably selecting a crimp ratio of the filling yarn constituting the woven fabric, it is possible to obtain a lining cloth of filamentary yarns of the present invention.

That is, these objects of the present invention are achievable by a lining cloth comprising a woven fabric in which the warp yarn comprises either polyester filamentary yarn or cellulosic filamentary yarn and the filling yarn comprises either a false-twisted polyester filamentary yarn, a raw filamentary yarn or a cellulosic filamentary yarn, characterized in that an elongation in the filling-wise direction of the woven fabric is in a range from 5% to 12%, a coefficient of dynamic friction on the surface of the woven fabric is in a range from 0.20 to 0.45, and a filling-wise crimp index value of the woven fabric, as defined by the following formula, is in a range from 0.003 to 0.013:

$$\text{Crimp ratio of filling yarn}/\{\text{warp density}\times(\text{warp fineness})^{1/2}\} \quad (1)$$

The lining cloth according to the present invention may be of any weave widely used as a woven fabric for a lining cloth, such as a plain weave, a twill weave or a satin weave.

The lining cloth according to the present invention can be produced by a method comprising the steps of narrowing a grey woven fabric prior to dyeing and either before or after scouring, at a narrowing ratio in a range from 5% to 30% of the width of the grey fabric woven from the above-identified filamentary yarn as a warp yarn and either a false-twisted polyester filamentary yarn or a raw polyester filamentary yarn as a filling yarn, and heat-setting the narrowed fabric at a temperature in a range from 160° C. to 210° C.

Alternatively, in a case where a grey fabric is woven of the above-mentioned yarn as the warp yarn and a cellulosic filamentary yarn as the filling yarn, the lining cloth of the invention can be produced by a method comprising heat-setting, prior to dyeing, the grey fabric at a narrowing ratio in a range from 5 to 15% at a temperature of from 100° C. to 210° C. at a condition where the grey fabric in unscoured state is wetted with water.

The narrowing ratio is defined by the following formula:

$$\text{Narrowing ratio (\%)}=\{(\text{width of grey fabric}-\text{width of narrowed fabric})/\text{width of grey fabric}\}\times 100$$

According to the present invention, by the heat-setting while narrowing the fabric width as defined above, it is possible to construct a weave structure highly increased in a warp density and in the number of crimps of the filling yarn by the filling-wise contraction of the fabric, whereby the resultant lining cloth exhibits an improved performance such as a reduced seam slippage, favorable softness, comfortable slipperiness as well as free from constrained feeling.

The filling-wise elongation, the coefficient of dynamic friction, the crimp ratio, the warp density, the warp fineness, the bending rigidity of the lining cloth used in the present invention are measured in accordance with the following methods on the finished fabric obtained after the dyeing and finishing treatment.

(1) Filling-wise Elongation

A tensile test of a fabric sample of 20 cm×20 cm size was carried out on a KES-FB1 available from Katoh Tec. K.K. (phonetic) wherein the sample is stretched at a tensile speed of 0.2 mm/sec in the filling-wise direction and an elongation S (%) at a tensile stress of 500 g/cm is determined by the following formula:

$$S=(A/B)\times 100$$

wherein A represents an elongated length (cm) at a tensile stress of 500 g/cm and B represents an original length (20 cm) of the fabric sample.

(2) Coefficient of Dynamic Friction

A friction test of the lining cloth was carried out by KES-SE available from Katoh Tec. K.K. (phonetic) wherein a frictional slider of 25 g weight having a frictional surface of 1 cm×1 cm size to which is attached a scoured cotton cloth of a plain weave No. 3 of shirting slides on a surface of the lining cloth fixed on a flat table at a speed of 5 cm/min.

From a frictional resistance obtained by this test, a coefficient of dynamic friction ($\mu$) is determined via the following formula:

$$\mu = A/B$$

wherein A represents a mean value (g) of the measured frictional resistance and B represents a weight of the slider (g). In this regard, the coefficient of dynamic friction of the lining cloth is an average of the measured value obtained when the slider slides in the warp-wise direction of the lining cloth and that obtain when sliding in the filling-wise direction.

(3) Crimp Ratio of Filling Yarn

The crimp ratio of a filling yarn was obtained in the following manner. A piece of a filling yarn is extracted from a portion of a woven fabric on which is marked a 20 cm length in the filling-wise direction, which then is loaded with a weight of 0.1 g/d and a length (S cm) thereof is measured. The crimp ratio is calculated by the following formula:

$$\text{Crimp ratio of filling yarn (\%)} = \{(S-20)/20\} \times 100$$

(4) Warp Density (End/Inch)

A warp density was determined by counting the number of warp yarns in one inch width of the woven fabric.

(5) Fineness of Warp Yarn (Warp Fineness)

A fineness of a warp yarn was determined by measuring a weight W (g) of two samples of warp yarn having a length of 90 cm under a load of 0.1 g/d, which was then calculated from the following formula:

$$\text{Fineness of warp yarn (denier)} = W \times 900000/180$$

(6) Filling-wise Bending Rigidity of Woven Fabric

A filling-wise bending rigidity of a woven fabric was determined by using KES-FB2 available from Katoh Tec. K.K. (phonetic) wherein a sample of a woven fabric in a size of 20 cm in the warp-wise direction ×20 cm in the filling-wise direction is grasped so that an effective sample length of 20 cm in the warp-wise direction and 1 cm in the filling-wise direction is obtained, which is then bent under the condition of the maximum curvature of ±2.5 $cm^{-1}$ and the bending speed of 0.50 $cm^{-1}$. A difference between bending moments per unit width (gf·cm/cm) at the curvatures of +0.5 $cm^{-1}$ and +1.5 $cm^{-1}$ (front side bending) was divided by the curvature (1 $cm^{-1}$) to result in a value (gf·$cm^2$/cm). This value is averaged with a similar value (gf·$cm^2$/cm) obtained from a difference between bending moments per unit width (gf·cm/cm) at the curvatures of −0.5 $cm^{-1}$ and −1.5 $cm^{-1}$ (back side bending) divided by the curvature (1 $cm^{-1}$).

The present invention will be described in more detail below.

To obtain a lining cloth which is an object of the present invention having reduced seam slippage, freedom from the constrained feel and excellent in surface smoothness, the lining cloth must be a woven fabric which is designed to have the filling-wise elongation and the coefficient of dynamic friction of the surface thereof in the above-identified range. That is, the filling-wise elongation of the lining cloth according to the present invention is preferably in a range from 5% to 12%, more preferably from 6% to 10%. As described before, an outer cloth generally has a filling-wise elongation in a range from 5% to 10% order. Contrarily, the conventional lining cloth has the filling-wise elongation of less than 3%. When a dress is practically put on, the lining cloth and the outer cloth are extended in accordance with the elongation of skin, during which a stress is liable to concentrate on lining cloth having a smaller filling-wise elongation, which causes the seam slippage and imparts a constrained feeling to the wearer. If the filling-wise elongation is less than 5%, it is impossible to absorb the stress applied to the lining cloth to result in seam slippage when, for example, sitting down or crouching while wearing a skirt. Also, since the wearing pressure becomes higher due to the tensile stress applied to the lining cloth, the constrained feel could not be mitigated.

If the filling-wise elongation is less than 5%, a hem of the lining cloth for the skirt rides up together with the outer cloth due to the stress applied to the lining cloth to deteriorate the wear comfort. On the contrary, a lining cloth having a filling-wise elongation exceeding 12% is free from the problem of seam slippage, but has an irregular surface for the sake of crimps of the filling yarn, which lower the slipperiness to worsen the wearing comfort. Such a lining cloth feels harsh due to the crimp of the filling yarn, particularly when the lining cloth is rubbed in the warp-wise direction, or has a bulky and/or harsh touch, both of which deteriorate the silhouette of the outer cloth.

To satisfy the requirement for slipperiness (smoothness) of the surface of the lining cloth according to the present invention, it is necessary for the coefficient of dynamic friction of the surface of the lining cloth to be in a range from 0.20 to 0.45. A preferable range of the coefficient of dynamic friction is variable in accordance with weave structures, for example, in a range from 0.22 to 0.45 in a plain weave; from 0.20 to 0.38 in a twill weave; and from 0.20 to 0.35 in a satin weave.

In the twill and satin weaves, since more warp yarns are exposed outside the filling yarns on the fabric surface than in the plain weave, the effect of the crimp of the filling yarn is less when the lining cloth is rubbed in the warp-wise direction, whereby the warp-wise frictional coefficient becomes smaller as defined above.

Since the lining cloth is too slippery if the frictional coefficient is less than 0.20, there may be a trouble when the wearer sits down on a chair or others in that the hem of the skirt easily slip relative to an outer cloth, a skin or a panty stocking, or the body is liable to slide on the chair. On the other hand, if the dynamic frictional coefficient is more than 0.45, the lining cloth is not slippery relative to a skin or a panty stocking to reduce the convenience of a skirt and deteriorate the touch. When such a lining cloth is used for a jacket or a coat, it is poor in slipperiness relative to a blouse, a dress shirt or a jacket worn under the coat to worsen the wear comfort.

According to the present invention, to balance the filling-wise elongation and the slipperiness of the lining cloth to each other and satisfy the soft touch and the mechanical property of the lining cloth against the frictional force (such as against the migration or fraying of the filling yarn), a filling-wise crimp index value of woven fabric defined by the following formula (1) should be selected to be in a specified range. As is apparent from this formula, the filling-wise crimp index value of woven fabric is a parameter for identifying a surface structure of a lining cloth in relation to a filling-wise elongation of the fabric and a cover factor of warp yarn (a ratio of an area of the warp yarns to a total area of the fabric surface).

$$\text{Crimp ratio of filling yarn}/\{(\text{warp density} \times (\text{warp fineness})^{1/2}\} \quad (1)$$

Preferably, the lining cloth according to the present invention is designed to have a filling wise crimp index value of woven fabric in a range from 0.003 to 0.013. The preferable filling wise crimp index is variable in accordance with weave structures; for example, in a range from 0.004 to 0.013 in a plain weave; from 0.003 to 0.0011 in a twill weave; and from 0.003 to 0.009 in a satin weave. If the filling-wise crimp index value is less than 0.003, either the crimp ratio of the filling yarn would be extremely small or the warp density or the warp fineness would be large even though the crimp ratio of the filling yarn is large. In the former case, a lining cloth is obtained which is nothing but one having a small filling-wise elongation. In the latter case, the resultant lining cloth is not one soft in touch but is one hard in touch because the cover factor of the warp yarn is excessively large. In this case, since the cover factor of the warp yarn is so large that the filling yarns are constrained by the warp yarns even though a crimp shape of the filling yarn is large, a desirable filling-wise elongation is not attainable. If the crimp index value exceeds 0.013, there would be assumed either a case wherein the crimp ratio of the filling yarn is large or a case wherein the warp density or the warp fineness is small. In such cases, the cover factor of the warp yarn is so small that the fabric structure in which the filling yarns are extremely slack is formed. Accordingly, the lining cloth lacks surface smoothness when it is exposed to a warp-wise frictional force and exhibits a harsh feel. Also, due to the small cover factor of the warp yarns, this lining cloth is defective in that the filling yarn is liable to migrate and fray when subjected to a warp-wise frictional force.

In addition, the lining cloth according to the present invention preferably has a filling-wise bending rigidity of 0.030 gf·cm$^2$/cm or less. If the filling-wise bending rigidity exceeds 0.030 gf·cm$^2$/cm, the touch of the lining cloth is extremely hard. Particularly, the lining cloth of the present invention has a filling-wise elongation in a range from 5% to 12%, which means that, while the crimp ratio of filling yarn (meandering of filling yarn) is large, the filling yarn is liable to fray. Therefore, it is necessary for the lining cloth according to the present invention to have a larger warp density than that of the conventional lining cloth having a filling-wise elongation of less than 3% so that the warp-wise cover factor becomes larger. As a result, the warp-wise bending rigidity becomes larger.

To achieve the softness suitable for the lining cloth, the filling-wise bending rigidity should be 0.030 gf·cm$^2$/cm or less.

If the filling-wise bending rigidity is 0.003 gf·cm$^2$/cm or less, the lining cloth is too soft and liable to stick to an inner clothing on the skin side, which deteriorates the wear comfort. Preferably, the filling-wise bending rigidity is 0.025 gf·cm$^2$/cm or less when a false-twisted polyester filamentary yarn is used as a filling yarn of the lining cloth. Such a lining cloth is soft in touch and does not damage the silhouette of the outer cloth. When a raw polyester filamentary yarn is used as a filling yarn of the lining cloth, the bending rigidity is more preferably 0.020 gf·cm$^2$/cm or less. While the adjustment of the filling-wise bending rigidity in the lining cloth wherein the raw polyester filamentary yarn is used as a filling yarn will be described later in more detail, the filling-wise elongation and the filling-wise bending rigidity are adjustable into the above-mentioned range by suitably selecting a raw polyester filamentary yarn which is easy to bend as a filling yarn. In the lining cloth wherein a cellulosic filamentary yarn is used as a filling yarn, the bending rigidity is preferably 0.030 gf·cm$^2$/cm or less.

By using the lining cloth of the present invention, it is possible to manufacture a dress having an anti-seam slippage performance as well as an excellent wear comfort without providing the "kise" (fullness work) which is necessary in the conventional lining cloth. The "kise" is provided for the purpose of improving the wear comfort, which is formed by cutting a lining cloth in a size somewhat larger than the mating outer cloth and folding the former along a line closer to a seam line so that the lining cloth is superfluous relative to the outer cloth. However, according to the lining cloth of the present invention, it is possible to eliminate such a "kise" because the lining cloth is stretchable in the filling-wise direction to improve the wear comfort and prevent the seam from slipping. Since there is no need for providing the "kise" when the lining cloth according to the present invention is used, as stated above, the operation for folding the lining cloth along a line closer to the seam line during the sewing process becomes unnecessary to simplify the same.

Any of a plain weave, a twill weave, a satin weave or an other may be adopted as a weave of the lining cloth of the present invention in accordance with the application fields and the required qualities of the lining cloth. For example, as for a woman's dress, a plain weave is favorably used because a thin and soft touch is preferable.

Polyester filamentary yarn used for the warp yarn of lining cloth according to the present invention includes a fiber from fiber-forming polyester polymer including homopolymer such as polyethylene terephthalate, polybutylene terephthalate or polytrimethylene terephthalate, or copolymer of these polymers. Additives may be added to the filament if necessary, such as an antistatic agent, heat stabilizer, flame-retardant, light stabilizer or titanium oxide. A cross-sectional shape of the filament is not limited but may include a circle, a polygon, such as a triangle, an L-shape, a Y-shape, a T-shape, a multi-lobal shape, a hollow shape, a flat shape or an indefinite shape.

The cellulosic filament used for the warp yarn includes cupra-ammonium rayon, viscose rayon, polynosic rayon and acetate filament.

The polyester or cellulosic filamentary yarn used as the warp yarn has a total fineness in a range from 30 to 120 deniers (d), preferably from 50 to 100 d. A fineness of single filament thereof may not be limited but is in a range from 0.5 to 10 d, preferably from 0.5 to 5 d.

The warp yarn is most preferably a non-twisted raw yarn (flat yarn). To enhance the cohesiveness of the yarn, however, the filament yarn may be lightly twisted (for example, approximately in a range from 10 to 200 T/M), or may be subjected to an interlacing treatment or a texturizing treatment such as false-twisting or air-jet processing. To obtain a special surface appearance or touch, a hard-twisted yarn may be used as a warp yarn.

A warp yarn used for the lining cloth of the present invention may be a false-twisted polyester filamentary yarn, a raw polyester filamentary yarn or a cellulosic filamentary yarn. While any combinations of fiber materials are allowable between the warp yarn and the filling yarn in the lining cloth, typical combinations thereof are as follows:

(1) The warp yarn is a 100% raw polyester filamentary yarn, and the filling yarn is either a 100% false-twisted polyester filamentary yarn or a 100% raw polyester filamentary yarn or a 100% cellulosic filamentary yarn.

(2) The warp yarn is a 100% cellulosic filamentary yarn, and the filling yarn is either a 100% false-twisted polyester filamentary yarn or a 100% raw polyester filamentary yarn or a 100% cellulosic filamentary yarn.

(3) The warp yarn is a polyester filamentary yarn land a cellulosic filamentary yarn, and the filling yarn is either a 100% false-twisted polyester filamentary yarn or a 100% raw polyester filamentary yarn or a 100% cellulosic filamentary yarn. More concretely, one or two polyester filamentary yarns and one or two cellulosic filamentary yarns are alternately arranged in the warp yarns. However, the arrangement and/or ratio thereof in the warp yarns is optional.

(4) The warp yarn is a 100% polyester filamentary yarn, and the filling yarn is a combination of a false-twisted polyester filamentary yarn, a raw polyester filamentary yarn or a cellulosic filamentary yarn, wherein the arrangement and/or ratio thereof is optional.

(5) The warp yarn is a 100% cellulosic filamentary yarn, and the filling yarn is a combination of a false-twisted polyester filamentary yarn, a raw polyester filamentary yarn or a cellulosic filamentary yarn, wherein the arrangement and/or ratio thereof is optional.

Any one of the above-mentioned combinations (1) to (5) of warp and filling yarns may be suitably selected in accordance with a type or a portion of a dress to which the lining cloth is applied or a demand for the lining cloth (for example, whether the dress is rinsed with water or subjected to a dry-cleaning). For instance, when the lining cloth is used for a dress which is inexpensive and easy-care (resistant to dimensional change and creases due to water rinsing) or repeatedly worn, a combination of 100% polyester filamentary yarn as a warp yarn and 100% false-twisted polyester filamentary yarn or 100% raw polyester filamentary yarn as a filling yarn is preferable. On the other hand, in an expensive dress required to have wearing comfort (for example, moisture absorption/release or antistatic property) and a drapability, a combination of 100% cellulosic filamentary yarns both in warp and filling yarns is preferable.

BEST MODES FOR CARRYING OUT THE INVENTION

The preferred methods for producing the lining cloths according to the present invention will be described in detail below in view of types of filling yarns used therefor.

[1] A Lining Cloth Wherein a False-twisted Polyester Filamentary Yarn is Used as a Filling Yarn There is no limitation in the false-twisted polyester filamentary yarn used as a filament yarn. The filling yarn may be a conventional false-twisted yarn produced in an industrial manner. For instance, such a false-twisted yarn includes those obtained from a spindle system, a circumferential friction system and a nip-belt friction system. There is no limitation in the false-twisting conditions, and either a single-heater system or a double-heater system may be adopted. While a crimpability of the false-twisted yarn is largely relied on the number of false twist, a temperature of a first theater and/or a second heater, a feed rate of the second heater or others, these conditions are optionally selectable.

On the other hand, the false-twisted yarn used as a filling yarn may be subjected to an interlacing treatment and/or a twisting treatment for the purpose of enhancing the cohesiveness thereof. Also, there is no limitation in kinds of raw yarns used for the false-twisting treatment, provided they are made of-fiber-forming polyester polymer such as polyethylene terephthalate, polybutylene terephthalate, polytrimetylene terephthalate or others. These yarns include a drawn yarn, a partially oriented yarn or an undrawn yarn obtained by a conventional spinning method, and those obtained by a high speed spinning method or a spin-draw takeup method. The polyester polymer referred to herein includes not only homopolymers but also copolymers. The filamentary yarn may contain additives such as an antistatic agent, a flame resistant, a heat resistant, a light resistant, titanium oxide or others. A cross-sectional shape of the filament may not be limited but includes a circle, a triangle, an L-shape, a Y-shape, a T-shape, a polygon, a multi-lobal shape, a hollow shape, a flat shape or an indefinite shape.

To facilitate both of filling-wise elongation and surface smoothness of the lining cloth, a treatment is necessary, as described before, for shrinking the fabric structure by the crimp development of the false-twisted yarn while constraining the warp yarns and the filling yarns. That is, after weaving and either prior to or after the scouring, a grey fabric is subjected to a narrowing treatment simultaneously with a heat-setting while being stretched both in the filling-wise and warp-wise directions, whereby the development of crepe or pebbled-surface effect is restricted to result in a lining cloth of a smooth surface having a filling-wise elongation in a range from 5% to 12%.

In other words, after a fabric has been woven from polyester or cellulosic filamentary warp yarns and false-twisted polyester filamentary filling yarns, by heat-setting the fabric at a temperature in a range from 160 to 210° C. prior to or after being scoured while narrowing a width thereof by 5 to 15% in comparison with that of a grey fabric, a lining cloth having a structure and a performance defined by the present invention is obtainable.

The 5 to 15% narrowing heat-setting results in the increase in a difference between a warp density as designed upon weaving and that of the finished fabric. According to the inventive method, upon the narrowing treatment, the warp-wise shrinkage is restricted to within 5% so that the increase in weft density is suppressed to as small a value as possible, namely so that the tensioned state is at a higher level in the warp-wise direction than in the filling-wise direction. As a result, fabric shrinkage accompanied with an increase in warp density is achievable.

The narrowing treatment is carried out, for example, by using a pin tenter which is widely used for the heat-setting of a woven fabric, wherein a grey fabric is heat-treated while maintaining the width thereof narrower than the original and tensioning the fabric in the warp-wise direction. A narrowing ratio should be in a range from 5% to 15%. The preferable range is variable in accordance with whether the false-twisted filling yarn is a false-twisted yarn obtained by a single-heater type apparatus or a double-heater type apparatus. This is because there is a difference between a dry heat shrinkage inherent to the respective false-twisted yarn and that due to the development of crimps. When the false-twisted yarn of the double-heater type is used, the narrowing ratio is preferably in a range from 5 to 10%. When the false-twisted yarn of the single-heater type is used, the narrowing ratio is preferably in a range from 7 to 15%. If the heat treatment is carried out at a narrowing ratio of less than 5%, it is impossible to obtain a fabric defined by the present invention because the shrinkage of fabric structure is too small to result in the desired filling-wise elongation. On the other hand, if the heat treatment is carried out at a narrowing ratio of 15% or more, the fabric is not tensioned but heat-set in a slackened state, which causes the generation of creases, surface undulations or curving of filling yarns.

By the heat treatment of a grey fabric in the present invention, crimps in the false-twisted yarn in the fabric develop under tension and, at the same time, the developing crimps are heat-set. If the false-twisted yarn is not sufficiently heat-set by this heat treatment, the shrinkage of the fabric structure would occur due to the crimp development during a post process subsequent to the heat treatment (for example, scouring or dyeing process). Consequently, a lining cloth with pebbled-surface effect results, which is poor in slipperiness, and has a harsh and bulky touch. The surface pebbled-surface effect generated at this time does not completely disappear even if the fabric is heat-treated in a tensioned state in the last finishing process. A temperature at which the crimp development and the heat-setting are completely performed is preferably in a range from 160° C. to 210° C., more preferably from 180° C. to 200° C. If the heat-treatment temperature is lower than 160° C., the crimp development and the heat-setting of the false-twisted yarn is insufficient and the crimp develops again in the scouring or dyeing process subsequent thereto to result in a lining cloth rich in surface pebbled-surface effect and poor in surface smoothness. Contrarily, if the temperature exceeds 210° C., fibers composing in the fabric are liable to be largely damaged to deteriorate the mechanical property of the lining cloth and cause the touch thereof to be hard.

A heat-treatment time duration is selected so that the crimp development and the heat-setting of the false-twisted polyester filamentary yarn used is completely achievable. If the heat-treatment temperature is higher, the heat-treatment time duration is shorter in view of the damage to fibers, while if the heat-treatment temperature is lower, the heat-treatment time duration is longer to that extent. The heat-treatment time duration is preferably in a range from 15 seconds to 60 seconds at a temperature in a range from 180° C. to 200° C.

Any means may be adopted for carrying out the above-mentioned heat treatment provided it processes the fabric in a tensioned state. Typically, a heat setter of a pin tenter type, which has a plurality of pins on the opposite side thereof and is widely used for the heat treatment of conventional woven fabrics, is favorable.

The scouring process referred to in this text is a process for removing, after the weaving process, spinning oil or sizing agent adhering to the woven fabric, wherein water or aqueous solution containing water, a surfactant and an alkaline is used as a treatment liquid. Any method may be used for carrying out the scouring process. Any apparatus widely used for scouring woven fabric may be adopted for this purpose, including an open soaper type continuous scouring apparatus, a liquid-stream type dyeing machine, a suspension-in-bath type continuous processor, a wince type dyeing machine and a Sofsa (phonetic) scouring apparatus.

When the scouring process is carried out on a woven fabric which has been heat-treated at a temperature in a range from 160° C. to 210° C. while being narrowed in width by 5% to 15% of the original width so that crimps of the false-twisted yarn in the woven fabric are heat-set prior to the scouring process, the liquid-stream type dyeing machine or the wince type dyeing machine excellent in relaxation effect may be adopted to obtain a lining cloth according to the present invention. Contrarily, when a woven fabric is heat-treated after having been processed by such a scouring apparatus excellent in relaxation effect, it is impossible to obtain a lining cloth as defined by the present invention because crimps of the false-twisted yarn develop in a large extent by the relaxation.

When the scouring process is carried out prior to the narrowing heat-treatment, an apparatus capable of applying tension to the woven fabric both in the warp-wise and filling-wise directions, such as an open soaper type continuous scouring apparatus, is preferably adopted. If an apparatus in which no tension is applied to the woven fabric both in the warp-wise and filling-wise directions is adopted for carrying out the scouring process, such as a liquid-stream type dyeing machine or a suspension-in-bath type continuous processor, unfavorable pebbled-surface effect might occur in the processed fabric. Even in the scouring process using the open soaper type continuous scouring apparatus, the treatment temperature is preferably as low as in a range from 40° C. to 60° C. for the purpose of restricting the crimp development to as low as possible. In this case, the removal of spinning oil or sizing agent adhered to the warp yarns may be insufficient. If so, the scouring process may be repeated after the narrowing heat-treatment.

The narrowing heat treatment is preferably carried out prior to the scouring process, whereby the lining cloth according to the present invention would be favorably obtainable. Such a sequence is advantageous in that any apparatus cited above may be adopted in the scouring process carried out later to achieve the object of the present invention. In addition thereto, the resultant lining cloth is excellent in surface smoothness as well as being less bulky in touch.

Subsequent to the heat treatment according to the present invention, a dyeing/finishing process, which is conventional in the production of lining cloth, is added. If a softer touch is desired, an alkaline weight reduction treatment may be carried out prior to the dyeing. The lining cloth of the present invention is free from seam slippage when actually worn even though the alkaline weight reduction treatment is carried out, because of the filling-wise elongation.

The dyeing process on the lining cloth, according to the present invention, composed of 100% polyester filamentary yarns may be carried out in accordance with that for the conventional lining cloth composed of polyester filamentary yarns. In the dyeing process, a liquid-stream type dyeing machine, a jigger dyeing machine, a beam dyeing machine and a wince dyeing machine are preferably used. Of them, the liquid-stream type dyeing machine is more favorable in view of the grade of the dyed product. The finishing process may be carried out in accordance with that for the conventional lining cloth composed of polyester filamentary yarns. Care must be taken in the widening heat treatment in the last finishing process by a pin tenter or the like for eliminating creases. In this treatment, if a width-increasing ratio is too large, the resultant lining cloth would have a lower filling-wise elongation compared to the desired value. The widened width is preferably larger, for example, by approximately in a range from 1 cm to 3 cm than the after-dyed width to solely eliminate creases. During the finishing process, a finishing agent such as anti-static agent, water repellent or sweat absorber may be optionally added. Also, to improve the luster, smoothness or touch of the surface of the woven fabric, a calendaring treatment may optionally be carried out.

The dyeing/finishing process of a lining cloth of a mixedly woven fabric comprising cellulosic filamentary yarns and false-twisted polyester filamentary yarns is carried out by initially scouring a grey fabric and dyeing a polyester component thereof as described above, and then dyeing a cellulosic component which may be carried out by the same dyeing machine as used for dyeing the polyester component, or by a cold pad batch method, a pad steam method or a jigger method.

The finishing process subsequent to the dyeing may optionally include a resin treatment usually used in the conventional process for the cellulosic fiber product for improving laundry shrinkage and friction fastness under wet conditions.

(2) A Lining Cloth Wherein a Raw Polyester Filamentary Yarn is Used as a Filling Yarn A preferable method for producing a lining cloth will be described wherein a raw polyester filamentary yarn is used as a filling yarn.

Such a lining cloth using a raw polyester filamentary yarn (flat yarn) as a filling yarn is softer in touch, improved in surface smoothness, less bulky in feeling as well as better in slipperiness.

This method is based on a principle in that the method would be possible to enhance structural shrinkage of a fabric effecting filling-wise elongation of the fabric under narrowing heat treatment by increasing a crimp ratio of the filling yarn in the structure of as-woven fabric (grey fabric), which inherently contributes to the filling-wise elongation and weakens the interlacing force between the warp and filling yarn.

The crimp ratio of the filling yarn in the grey fabric is necessarily 1.5% or more, preferably 2% or more. In this regard, the crimp ratio of a raw polyester filamentary filling yarn in the conventional lining cloth was 1% or less. The lining cloth of the present invention is obtainable by using an easily-bendable raw filamentary yarn capable of attaining the crimp ratio of the filling yarn of 1.5% or more in a grey fabric which is then subjected to a narrowing heat treatment in a range from 5% to 30%.

If the fabric using the easily-bendable raw yarn as a filling yarn is heat-treated at a temperature in a range from 160° C. to 210° C. either prior to or after the scouring, while narrowing the width thereof by 5 to 30%, regular and rigid crimps are formed in the filling yarn to contribute to a high filling-wise elongation.

Also, since the raw yarn is used as a filling yarn, there is neither a harsh touch nor insufficient slipperiness when a hand is slid on a fabric surface in the warp-wise direction.

The narrowing heat treatment in a range from 5% to 30% causes the large difference in warp density between the grey fabric and the finished fabric. According to the method of the present invention, the grey fabric having the crimp ratio of 1.5% or more is subjected to the narrowing treatment under the condition wherein the warp-wise shrinkage is restricted to be 5% or less i.e., without substantial increase of the filling yarn density so that the tensioned state is maintained in the warp-wise direction rather than in the filling-wise direction, resulting in the structural shrinkage of fabric caused by the increase in warp density.

The narrowing treatment according to the present invention is carried out, for example, by a heat setter of a pin tenter type generally used for the heat treatment of fabrics, wherein a grey fabric or a scoured fabric is heat-treated while maintaining the width thereof at a predetermined value smaller than the original width and tensioning in the warp-wise direction more than in the filling-wise direction.

The narrowing ratio is in a range from 5% to 30%, preferably from 10% to 25%. The favorable range of the narrowing ratio is variable in accordance with the ease of bending of a raw yarn used as a filling yarn. Also, the narrowing ratio is effected by a dry heat shrinkage of the raw yarn itself. Thus, it is important that the optimum narrowing ratio is selected from the above-mentioned range in a range from 5% to 30% based on the study of the physical properties of the raw yarn.

If the narrowing ratio is 5% of less, the resultant lining cloth has the unsatisfactory filling-wise elongation of 5% or less. The lining cloth having the filling-wise elongation of 5% or less has no sufficient anti-seam slippage effect and is in the same category as the conventional lining cloth. Contrarily, if the filling-wise elongation exceeds 30%, there are problems in that the tensioned state is low in the filling-wise direction to generate crease in the fabric land cause bowing of the filling yarns in the fabric structure. Also, the crimp of the filling yarn becomes excessively large to allow the filling yarn to bulge on the fabric surface. This causes the lining cloth to be harsh in touch and deteriorates the wear comfort.

The heat treatment of the grey fabric is one of important processes according to the present invention wherein the filling-wise shrinkage of the fabric structure is obtained, as designed, to increase the warp density as well as the crimp of the filling yarn, and the filling yarn is sufficiently heat-set to form a rigid crimp.

If the heat-setting of the raw yarn is insufficient in this heat treatment, a defective lining cloth poor in filling wise elongation is the result, because the filling yarn is liable to shrink when heated in a process subsequent to the heat treatment (for example, scouring or dyeing process). Also creases may occur. The crease generated in this stage is not completely remedied even by a tensioned heat set in a final finishing process.

The heat treatment temperature under which the shrinkage of fabric structure and the heat set are sufficiently done is preferably in a range from 160° C. to 210° C. More preferably, it is in a range from 180° C. to 200° C. If the heat treatment temperature is lower than 160° C., the heat setting of the filling yarn becomes insufficient to cause a lack of filling-wise elongation and generation of creases. If it exceeds 210° C., the warp and filling yarns are damaged by heat to deteriorate the mechanical properties of the resultant lining cloth, which also increases the rigidity of the lining cloth, resulting in harsh touch.

The raw polyester filamentary yarn used as filling yarn is a flat yarn by a conventional spinning method, a spin-draw takeup method or a high-speed spinning method and is not subjected to a texturizing process such as false-twisting, stuffing, gear-crimping, knit-deknitting or fluid-jetting. In this regard, the raw yarn may be interlaced or lightly-twisted to facilitate the cohesiveness of filaments composed of the same. As the raw polyester filamentary yarn, filamentary yarn made from a fiber-forming polyester polymer selected from homopolyester such as polyethylene terephtahlate, polybutylene terephthalate or polytrimethylene terephthalate and copolyester can be used. The polyester polymer includes not only a homopolymer but also copolymer. These polymers may be added with optional additives such as an anti-static, a flame resistant, a heat resistant, a light resistant or titanium oxide. To obtain a lining cloth having a proper bending rigidity and a filling-wise elongation in a range from 5% to 12% defined by the present invention, a easily-bendable raw yarn is preferably used as a filling yarn.

When the raw yarn is composed of a filament yarn having a circular cross-sectional shape, a diameter of a single filament is preferably smaller because such a filling yarn is easily bendable to wrap around a warp yarn and causes a crimp size of the filling yarn to enlarge. Therefore, a multifilamentary yarn is preferable. A total fineness of the raw yarn is preferably in a range from 30 denier to 100 denier, and a fineness of single filament is preferably in a range from 0.1 denier to 3.0 denier, more preferably from 0.2 denier to 2.0 denier.

The cross-sectional shape of the single filament may be either circular or non-circular. The non-circular cross-section may be of a polygonal shape such as triangular, an L-shape or a Y-shape, a multi-lobal shape, a hollow shape or an indefinite shape. A flat shape and an oval shape are particularly favorable because they are easily bendable in a specified direction.

The flat shape referred to herein includes a substantial flat shape such as a W-shape, an I-shape, a boomerang shape, a wave shape, a ball-array shape, which has a sectional structure easily bendable in a specified direction.

To further facilitate the ease of bending, the above-mentioned single filament of a non-circular cross-section is preferably used as a multifilamentary yarn. In the flat type and the oval type, a fineness of the single filament is in a range from 0.5 denier to 4 denier, preferably from 0.5 denier to 3 denier.

Irrespective of whether the raw yarn is composed of filaments each having a circular cross-section or a non-circular cross-section, if the crimp ratio of the filling yarn in the grey fabric of 1.5% or more, preferably 2% or more is attainable by such a raw yarn, it is possible to obtain the lining cloth of the present invention. No limitation exists in kinds of polymer and types of spinning method.

By using the easily-bendable raw yarn, the resultant lining cloth is soft in touch and exhibits the bending rigidity in the filling-wise direction of the fabric of 0.030 $gf \cdot cm^2/cm$ or less, preferably 0.020 $gf \cdot cm^2/cm$ or less.

The time for the heat treatment according to the present invention should be sufficient for heat-setting the shrinkage of fabric structure and the crimp in the filling yarn. If the heat-treatment temperature is higher, the heat-treatment time must be shorter to prevent the warp and filling yarns from being damaged, while if the heat-treatment temperature is lower, the heat-treatment time must be longer. The heat-treatment time is preferably in a range from 15 seconds to 60 seconds at the heat-treatment temperature in a range from 180° C. to 200° C. The heat treatment may be carried out by conventional apparatuses capable of treating the fabric in a tensioned state both in the warp-wise direction and the filling-wise direction. A heat setter of a pin tenter type widely used for the fabric heat treatment, having pins at the opposite edges thereof, is favorably used.

The scouring carried out in the present invention is a process for removing spinning oil or warp-sizing agent from the grey fabric, wherein a treatment liquid used in the scouring process is preferably water or aqueous solution containing surfactant and alkali. The scouring process may be carried out by using an open soaper type continuous scouring apparatus, a liquid-stream type dyeing machine, a bath-suspension type continuous treatment apparatus, a wince dyeing machine or a sofsa scouring apparatus which is conventionally used for the fabric scouring.

While the narrowing heat treatment may be carried out either prior to or after scouring the fabric,the heat treatment prior to the scouring is favorable for the purpose of achieving a softer touch and a larger filling-wise elongation.

After the narrowing heat treatment and the scouring process, a dyeing/finishing process is carried out as for the conventional lining cloth.

If a softer touch is desired, a weight reduction treatment with alkali may be adopted prior to dyeing. Generally, the weight reduction treatment with alkali contributes to the improvement in touch, but creates larger interstices between warp yarns and filling yarns land tends to cause the seam slippage. Since the lining cloth according to the present invention has a suitable filling-wise elongation, the seam slippage during the wearing is significantly reduced even though a weight reduction treatment with alkali is adopted.

The dyeing of the lining cloth of 100% polyester filamentary yarns may be carried out by using a liquid-stream type dyeing machine, a jigger dyeing machine or a wince dyeing machine which is usually used for dyeing the conventional lining cloth of polyester filamentary yarns. Of them, the liquid-stream type dyeing machine is favorable in view of the grade of dyed product and the production cost thereof.

As for the finishing process after dyeing, a method widely used for finishing the conventional lining cloth of polyester filamentary yarns is adopted as in the dyeing process. Care must be taken so that the fabric width is not excessively widened when heat-treated for the purpose of removing crease in the final finishing process, for example, by a pin tenter or the like because a larger widening of width results in the lining cloth poor in filling-wise elongation. For instance, the widened width must be larger by a range from 1 cm to 3 cm than the width of the as-dyed fabric.

In the finishing process, finishing additives may be optionally added to the fabric, such as an anti-static, a water-repellent or a sweat-absorbing agent. To improve the luster, smoothness and touch of the fabric surface, a calendering treatment may be carried out after applying the finishing agent.

When a lining cloth of a mixed woven fabric comprising cellulosic filamentary yarns/polyester filamentary yarns is dyed, after the narrowing and the scouring, a polyester component used as filling yarn is initially dyed as described above. Then, a cellulosic component may be dyed by using the same dyeing machine as used for dyeing the polyester component. Alternatively, another dyeing machine may be used, such as that of a cold pad batch type or a zigger type.

In the finishing process subsequent to the dyeing, a resin treatment may be applied, which is usually adopted in the finishing of cellulosic fiber product for improving the laundry shrinkage and the fastness to wet friction.

(3) A Lining Cloth Wherein a Cellulosic Filamentary Yarn is Used as Filling Yarn A preferable production method will be described when the cellulosic filamentary yarn is used as a filling yarn.

It has been well known that the shrinkage of fabric structure occurs when the cellulosic fiber fabric is dipped in water due to the swelling of fiber. The lining cloth of the present invention is produced by maximally using the water-swelling property of cellulosic fiber to shrink the fabric structure.

That is, a grey fabric composed of warp yarns of polyester filamentary yarns or cellulosic filamentary yarns and filling yarns of cellulosic filamentary yarns is imparted with water prior to scouring, and is heat-treated at a temperature in a range from 100° C. to 210° C. while narrowing the width thereof by 5 to 15% relative to that of the original grey fabric, whereby a lining cloth having a filling-wise elongation in a range from 5% to 12% is obtained.

The 5 to 15% narrowing heat treatment is carried out in the same manner as in the fabric composed of filling yarns of false-twisted polyester filamentary yarns or raw polyester filamentary yarns with the exception in that the grey fabric is imparted with water prior to being heat-treated while the width thereof is narrowed.

Since the cellulosic filamentary fiber, typically cupra-ammonium rayon and viscose rayon, is rich in amorphous regions in comparison with natural cellulosic fiber, such as cotton, the change in fiber diameter due to swelling when dipped in water is larger to easily cause the shrinkage of fabric structure. However, the cellulosic filamentary fabric having the filling-wise elongation defined by the present invention is obtainable by the narrowing heat treatment carried out at a higher temperature during the swelling.

The cellulosic filamentary yarn used as filling yarn may be of cupra-ammonium rayon, viscose rayon, polynosic rayon or cellulosic acetate fiber. Of them, cupra-ammonium rayon and viscose rayon are particularly preferable because they are readily swollen with water land result in a fabric having a predetermined high filling-wise elongation. If a fiber which is less swollen with water is used, a compound for improving the degree of swelling described later may be added to a swelling liquid to obtain a desired swelling action.

When cupra-ammonium rayon, viscose rayon or polynosic rayon is used as filling yarn, the lining cloth of the present invention is not obtainable without the water-dipping process. In a case of acetate cellulosic fiber, a lining cloth having a filling-wise elongation in a range from 5% to 8% is obtainable even without the water-dipping, while a larger elongation is results from the water-dipping.

The cellulosic filamentary yarn used has a total fineness in a range from 30 denier to 120 denier, preferably from 50 denier to 100 denier, composed of a single filament fineness in a range from 0.5 denier to 10 denier, preferably from 0.5 denier to 5 denier. It may favorably be a non-twisted raw yarn, an interlaced yarn or a soft-twisted yarn (of approximately 10 to 200 T/m) for the purpose of enhancing the filament cohesiveness, but may be a textured yarn produced by a false-twisting method, air-jetting method or others, if necessary.

It is preferable to evenly impart the grey fabric with water prior to scouring. Suitable means to do so includes a dipping method, a spray method or a kiss roll method. Of them, the dipping method is the best in view of the operational stability and the processing cost. In the dipping method, a fabric is easily and evenly imparted with water by continuously passing through a water bath in a period from about 1 second to about 30 seconds. To facilitate the swelling of cellulosic filamentary yarn, an alkali compound such as sodium hydroxide, potassium hydroxide, lithium hydroxide or sodium carbonate may be added to water bath in a range from 0.5% to 10% by weight. The water temperature is not limited but is preferably in range from a normal temperature to 100° C.

After being imparted with water, the fabric preferably passes a dehydrating device such as a mangle disposed between the dipping bath and the heat-treatment apparatus prior to the narrowing heat treatment to remove excessive water from the fabric surface, which contributes to the uniformity of quality.

When the fabric is heat-treated with a heat setter of a pin tenter type usually used for processing the conventional fabrics, the grey fabric or the scoured fabric to be heat-treated is fixed at opposite edges thereof while tensioned in the warp-wise direction. Thereby, the fabric has a width narrower than that of the grey fabric.

According to the present invention, the narrowing ratio is in a range from 5% to 15%, preferably from 6% to 13%. The preferable range of the narrowing ratio is variable in accordance with kinds of cellulosic filamentary yarn used as a filling yarn. Corresponding to the degree of swelling of the cellulosic filament used, an optimal narrowing ratio is selected within a range from 5% to 15%. When the narrowing ratio is less than 5%, the resultant lining cloth becomes poor in a filling-wise elongation of less than 5%. Contrarily, when the narrowing ratio exceeds 15%, creases may generate in the fabric or the filling yarn is liable to be bowed in the ground structure. Also, a crimp size of the filling yarn in the fabric becomes excessively large to allow the filling yarn bulge on the fabric surface to result in a lining cloth harsh in touch and poor in wearing comfort.

In the heat treatment of the grey fabric, it is necessary to instantaneously dry the swelling cellulosic filament so that the filling-wise shrinkage of the fabric structure occurs as designed to increase the warp density. This process is important for enlarging the crimp size of the filling yarn. If the fabric does not instantaneously dry in this heat treatment, shrinkage of the filling yarn on its own occurs to result in a lining cloth poor in elongation and also creases may be generated. The creases generated in this stage do not completely disappear even though the fabric is heat-treated under tension during the final finishing process.

A heat treatment temperature for sufficiently shrinking and heat-setting the fabric structure is preferably in a range from 100° C. to 210° C., more preferably from 130° C. to 200° C. If the heat treatment temperature is lower than 100° C., the instantaneous drying of the swelling filling yarn is impossible, whereby the filling-wise elongation becomes insufficient or crease is liable to generate. Contrarily, if the heat treatment temperature exceeds 210° C., the warp yarn and the filling yarn are damaged by heat to result in a lining cloth hard in touch and inferior in mechanical properties.

A sufficient shrinkage must occur in the fabric structure within a heat treatment time of the present invention. If the heat treatment temperature is high, a shorter heat treatment time is selected in view of the damage to the warp and filling yarns, while if the heat treatment temperature is low, a longer heat treatment time should be selected. A preferable heat treatment time is in a range from 15 seconds to 180 seconds when the temperature is in a range from 130 to 200° C.

A suitable heat treatment apparatus is are capable of treating the fabric in a tensioned state both in the warp-wise and filling-wise directions. Especially, a heat setter of a pin tenter type having pins at opposite edges thereof is favorably adopted, which has been widely used for the heat treatment of the conventional fabrics.

After being swollen with water and heat-treated while the width narrows, the fabric is then scoured for the purpose of removing spinning oil or sizing agent therefrom. A treatment liquid used for the scouring is favorably water or an aqueous solution containing surfactant and alkali. An apparatus used for this purpose is not limited but may be one used for scouring conventional fabrics, including an open soaper type continuous scouring apparatus, a liquid-stream type dyeing machine, a bath-suspension type continuous processing apparatus, a wince type dyeing machine and a sofsa scouring apparatus. Of them, the open soaper type continuous scouring apparatus and the jigger dyeing machine are favorable in view of the productivity and the generation of creases.

The scoured fabric may be processed by optional treatments conventionally applied to a lining cloth composed of cellulosic filaments. For example, the fabric may be dyed with suitable dyes by a liquid-stream dyeing method, a jigger dyeing method, a beam dyeing method, a cold pad batch method, a pad steam dyeing method, a pad roll dyeing method or others in accordance with kinds of cellulosic filament used as filling and warp yarns.

Also, a fabric composed of warp yarns of polyester filament and weft yarns of cellulosic filament may be dyed in the same manner as described above, wherein the same dyeing machine as used for dyeing the polyester component may be used for dyeing the cellulosic component, or a different dyeing machine, for example, of a cold pad batch method, a pad steam method or a zigger method may be used for this purpose.

A resin treatment may be applied to the fabric in the finishing process after dyeing, for improving the laundry shrinkage and the fastness to wet friction, as conventionally used for processing the cellulosic fiber product. Care must be taken so that the fabric width is not excessively widened when heat-treated for the purpose of removing creases in the final finishing process, for example, by a pin tenter or the like because a larger widening of the width results in a lining cloth poor in filling-wise elongation. For instance, the widened width must be larger by from 1 cm to 3 cm than the width of the as-dyed fabric.

A finishing agent such as an antistatic, a water repellent or a sweat-absorbing agent may be applied to the fabric in the finishing process. To improve the luster, smoothness and touch of the fabric surface, a calendering treatment may be applied to the fabric.

The lining cloth using filling yarn of cellulosic filament according to the present invention has a fabric structure resistant to shrinkage because it has a filling-wise elongation in a range from 5% to 12% and a large crimp size in the filling yarn. Thus, the lining cloth is excellent in dimensional stability against domestic laundry as well as in crease resistance.

The present invention will be described below in more detail with reference to Examples, but is not limited thereto.

EXAMPLES

Physical properties used for estimating the product quality are measured as follows:

(1) Measurement of Filling-wise Elongation of Fabric

A tensile test of a fabric sample of 20 cm×20 cm size was carried out by KES-FB1 available from Katoh Tec. K.K. (phonetic) wherein the sample is stretched at a tensile speed of 0.2 mm/sec in the filling-wise direction and an elongation S (%) is determined by the following formula:

$$S=(A/B)\times 100$$

wherein A represents an elongated length (cm) at a tensile stress of 500 g/cm and B represents an original length (20 cm) of the fabric sample.

(2) Measurement of Coefficient of Dynamic Friction

A friction test of the lining cloth was carried out by KES-SE available from Katoh Tec. K.K. (phonetic) wherein a frictional slider of 25 g weight having a frictional surface of 1 cm×1 cm size to which is attached a scoured cotton cloth of a plain weave No. 3 of shirting slides on a surface of the lining cloth fixed on a flat table at a speed of 5 cm/min. From a frictional resistance obtained by this test, a coefficient of dynamic friction ($\mu$) is determined via the following formula:

$$\mu=A/B$$

wherein A represents a mean value (g) of the measured frictional resistance and B represents a weight of the slider (g). In this regard, the coefficient of dynamic friction of the lining cloth is an average of the measured value obtained when the slider slides in the warp-wise direction of the lining cloth and that obtained when sliding in the filling-wise direction.

(3) Measurement of Crimp Ratio of Filling Yarn

A crimp ratio of a filling yarn was obtained in the following manner. A piece of a filling yarn is picked up from a portion of a grey fabric or a dyed and finished fabric on which is marked a 20 cm length in the filling-wise direction, which then is loaded with a weight of 0.1 g/d and a length (S cm) thereof is measured. The crimp ratio is calculated by the following formula:

$$\text{Crimp ratio of filling yarn (\%)}=\{(S-20)/20\}\times 100$$

(4) Warp and Filling Density of Woven Fabric

A fabric density was determined by counting the number of warp yarns in one inch width of the woven fabric.

(5) Fineness of Warp Yarn (Warp Fineness)

A fineness of a warp yarn was determined by measuring a weight W (g) of two samples of warp yarn having a length of 90 cm under a load of 0.1 g/d, and substituting the measured value in the following formula:

$$\text{Fineness of warp yarn (denier)}=W\times 900000/180$$

(6) Filling-wise Bending Rigidity of Woven Fabric

A filling-wise bending rigidity of a woven fabric was determined by using KES-FB2 available from Katoh Tec. K.K. (phonetic) wherein a sample of a woven fabric in a size of 20 cm in the warp-wise direction ×20 cm in the filling-wise direction is grasped so that an effective sample length of 20 cm in the warp-wise direction and 1 cm in the filling-wise direction is obtained, which is then bent under the condition of the maximum curvature of ±2.5 $cm^{-1}$ and the bending speed of 0.50 $cm^{-1}$. A difference between bending moments per unit width (gf·cm/cm) at the curvatures of +0.5 $cm^{-1}$ and +1.5 $cm^{-1}$ (front side bending) was divided by the curvature (1 $cm^{-1}$) to result in a value (gf·$cm^2$/cm). This value is averaged with a similar value (gf·$cm^2$/cm) obtained from a difference between bending moments per unit width (gf·cm/cm) at the curvatures of −0.5 $cm^{-1}$ and −1.5 $cm^{-1}$ (back side bending) divided by the curvature (1 $cm^{-1}$).

(7) Estimation of Surface Appearance of Fabric

Creases, pebbled-surface effects or others were observed by naked eyes and hand feeling.

◎: very good

○: good

Δ: slightly not good

×: not good (8) Estimation of Touch of Fabric

Touch was estimated by an organoleptic test.

◎: very good

○: good

Δ: slightly not good

×: not good (9) Estimation of Seam Slippage

A tight skirt was prepared from an outer cloth of wool (twill weave, a basis weight of 290 g/$m^2$, a thickness of 0.55 mm, a warp/filling density of 88/71) having a warp/filling-wise elongation of 15%/10% and a lining cloth prepared by each of the following Examples of the present invention (the skirt is patterned with a 5% margin relative to a body size but there is no "kise" in the lining cloth). After the tight skirt was worn by a monitor for 4 weeks, the seam slippage was estimated by measuring the maximum slippage between opposite sides of the seam while applying a load of 0.5 kg/2.54 cm.

(10) Estimation of Wearing Comfort

A tight skirt was prepared from an outer cloth of wool (twill weave, a basis weight of 290 g/$m^2$, a thickness of 0.55 mm, a warp/filling density of 88/71) having a warp/filling-wise elongation of 15%/10% and a lining cloth prepared by each of the following Examples of the present invention (the skirt is patterned with a 5% margin relative to a body size but there is no "kise" in the lining cloth). An organoleptic test was carried out, by a monitor, on wearing comfort.

◎: very good

○: good

Δ: slightly not good

×: not good

(11) Measurement of Wearing Pressure

Five sensors were attached to left and right sides, respectively, of a hip portion of a monitor wearing the tight skirt used for the above-mentioned estimation of wearing comfort, and a pressure applied to the respective sensors when the monitor crouches was measured by a clothing pressure meter (Type AM13037-10) marketed from (K.K.) AMI, a mean value of which is used as the wearing pressure.

The following Examples 1 to 11 and Comparative Examples 1 to 7 are those of woven fabrics of a plain weave in which false-twisted polyester filamentary yarns are used as filling yarns.

Example 1

A grey fabric of a plain weave was woven from warp yarns of raw polyethylene terephthalate filamentary yarn of 50d/24f and filling yarns of false-twisted polyethylene terephthalate filamentary yarn of of a double-heater type of 75d/36f (the number of false-twist of 3350 T/M, a first heater temperature of 220° C., a second heater temperature of 180° C., a feed rate in the second heater zone of +20%), which has a warp density of 100 ends/inch, a filling density of 81 picks/inch, a basis weight of 50 g/m$^2$ and a fabric width of 131.5 cm.

The grey fabric was narrowed in width by 5% relative to the original width in a pin tenter under the condition of 190° C.×30 seconds. Then, the fabric was scoured in a liquid-stream type dyeing machine with an aqueous solution containing sodium carbonate of 2 g/l and Scourol (marketed by Kao K.K.) of 2 g/l under the condition of 130° C.×10 minutes. Thereafter, the fabric was dyed by a liquid-stream type dyeing machine under the condition described in Table 1 and reduction-scoured to result in a dyed fabric. The dyed fabric was finished under the condition described in Table 2 to result in a lining cloth.

TABLE 1

Dyeing condition

| Dyeing condition | |
|---|---|
| dyeing method | liquid-stream dyeing method |
| dye | C.I DISPERSE BLUE 291 of 1% owf |
| dispersant | DISPER TL (MEISEI KAGAKU K.K.: Tamol type) of 1 g/l |
| PH adjustor | acetic acid of 0.5 cc/l |
| dyeing temperature | 130° C. |
| dyeing time | 30 minutes |

TABLE 2

| Finishing condition | |
|---|---|
| finishing method | pad dry curing method |
| water repellent | NK GUARD FGN800 (NIKKA KAGAKU K.K.) of 1% by weight |
| antistatic | MEWLON AS222 (MIYOSHI YUSHI K.K.) of 1% by weight |

Note 1: Finishing process
A finishing process was carried out as follows: The fabric was impregnated with a treatment liquid and squeezed at a mangle pressure of 5 kg, dried at 100° C. for one minute, and heat-treated at 170° C. for 30 seconds.

Example 2

The same process was repeated as in Example 1, except that the narrowing ratio was 10%, and a lining cloth was prepared.

Example 3

A grey fabric of a plain weave was woven from warp yarns of raw polyethylene terephthalate filamentary yarn of 50d/24f and filling yarns of false-twisted polyethylene terephthalate filamentary yarn of a single-heater type of 75d/36f (the number of false-twist of 3300 T/M, a heater temperature of 220° C.), which has a warp density of 121 ends/inch, a filling density of 82 picks/inch, a basis weight of 59 g/m$^2$ and a fabric width of 123.0 cm.

The grey fabric was narrowed in width by 5% relative to the original width in a pin tenter under the condition of 190° C.×30 seconds. Then, the fabric was scoured in an open soaper type continuous scouring apparatus under the condition described in Table 3, and subjected to the weight reduction treatment with alkali under the condition described in Table 4. The weight-reduced fabric was dyed and finished as described in Table 1 to result in a lining cloth.

TABLE 3

| Scouring method |
|---|
| Continuous scouring process |
| scouring--->rinsing with hot water--->dehydrating--->Drying<br>90° C. 80° C. 120° C.<br>NaOH of 5 g/l<br>surfactant (nonionic type) of 2 g/l |

TABLE 4

| Condition for weight reduction treatment with alkali | |
|---|---|
| weight-reduction method | pad steam method |
| caustic soda | 250 g/l |
| penetrant | NEORATE NA30 of 10 g/l |
| squeezing ratio | 40% by weight |
| weight reduction ratio | 8% by weight |

Example 4

The same process was repeated as in Example 3, except that the narrowing ratio is 10%, and a lining cloth was prepared.

Example 5

The grey fabric obtained by Example 3 was initially scoured by a continuous scouring apparatus under the condition described in Table 3, except that both of the scouring temperature and the rinsing temperature are lowered to 50° C. Subsequently, the resultant fabric was subjected to narrowing at a narrowing ratio of 10% relative to the gray fabric at 190° C. for 30 seconds by a pin tenter, and then dyed under the same condition as in Example 3.

Example 6

The same process was repeated as in Example 3, except that the narrowing ratio is 15%, and a lining cloth was prepared.

Example 7

Example 1 was repeated except that the heat treatment is carried out at 180° C. for 60 seconds.

Example 8

A grey fabric of a plain weave was woven from warp yarns of cupra-ammonium rayon filamentary yarn of 50d/30f and filling yarns of a false-twisted polyethylene terephthalate filamentary yarn of a single-heater type of 75d/36f (the number of false-twist of 3300 T/M, a heater temperature of 220° C.), which has a warp density of 131 ends/inch, a filling density of 82 picks/inch, a basis weight of 63 g/m$^2$ and a fabric width of 132.0 cm.

The grey fabric was narrowed in width by.10% relative to the original width under the condition of 190° C.×30 seconds. Then, the fabric was de-sized and scoured under the condition described in Table 3, dyed under the condition described in Table 5, and resin-treated under the condition described in Table 6 to result in a lining cloth.

TABLE 5

| Dyeing condition | |
|---|---|
| dyeing method | a liquid-stream type dyeing machine |
| dye | C.I Disperse Blue 291 of 1% owf<br>C.I Direct Blue 291 of 1% owf |
| dispersant | Disper TL (MEISEI KAGAKU: Tamol type) of 1 g/l |
| sodium sulfate | 50 g/l |
| temperature × time | 130° C. × 60 minutes |
| bath ratio | 1:20 |
| pH of dye bath | 5.5 |

TABLE 6

| Finishing condition | |
|---|---|
| finishing method | pad dry cure method |
| resin | Sumitex Resin NF-500K 5% by weight (SUMITOMO KAGAKU 1.3 dimethylglyoxal urea type) |
| catalyst | Sumitex ACC X-110 (SUMITOMO KAGAKU: composite metallic salt type) of 1.5% by weight |
| softening agent | Nikka MS-1F (NIKKA KAGAKU: methylolamide type) |

Note 1) resin treatment process
A resin treatment process was carried out as follows: The fabric was impregnated with a treatment liquid and squeezed at a mangle pressure of 5 kg, dried at 100° C. for one minute, and heat-treated at 160° C. for 2 minutes.

Example 9

A grey fabric of a plain weave was woven from warp yarns of viscose rayon filamentary yarn of 75d/33f and filling yarns of a false-twisted polyethylene terephthalate filamentary yarn of a single-heater type of 75d/36f (the number of false-twist of 3300 T/M, a heater temperature of 220° C.), which has a warp density of 115 ends/inch, a filling density of 82 picks/inch and a fabric width of 132.0 cm.

The grey fabric was narrowed in width by 10% relative to the original width under the condition of 190° C.×30 seconds. Then, the fabric was de-sized, scoured, dyed and resin-treated under the same conditions as in Example 8 to result in a lining cloth.

Example 10

A grey fabric of a plain weave was woven from warp yarns of polyethylene terephthalate filamentary yarn of 75d/36f and filling yarns of a false-twisted polyethylene terephthalate filamentary yarn of a single-heater type of 75d/36f (the number of false-twists of 3300 T/M, a heater temperature of 220° C.), which has a warp density of 121 ends/inch, a filling density of 82 picks/inch, a basis weight of 59 g/m$^2$ and a fabric width of 123.0 cm.

The grey fabric was narrowed in width, scoured, dyed and finished under the same condition as in Example 3 to result in a lining cloth.

Example 11

The grey fabric obtained by Example 10 was narrowed in width, scoured, dyed and finished under the same condition as in Example 4.

Comparative Example 1

The same process was repeated as in Example 1, except that the heat treatment is not carried out prior to the scouring. The finished fabric had a width of 101 cm which means that a narrowing ratio was 23% relative to the grey fabric.

Comparative Example 2

The grey fabric obtained by Example 1 (of 131.5 cm wide) was soured by a liquid-stream type dyeing machine with the same scouring liquid as in Example 1 at 130° C. for 10 minutes, and heat-treated by a pin tenter so that a narrowing ratio of 10% (a fabric width of 118.4 cm) was obtained relative to the grey fabric. Then, the fabric was dyed and finished under the same condition as in Example 1 to obtain a lining cloth.

Comparative Example 3

The grey fabric obtained by Example 1 was processed in the same manner as in Example 1 except that the narrowing ratio is 3%.

Comparative Example 4

The grey fabric obtained by Example 3 was processed in the same manner as in Example 1 except that the narrowing ratio is 20%.

Comparative Example 5

The same process was repeated as in Example 1 except that the heat treatment is carried out at 150° C. for 2 minutes to result in a lining cloth.

Comparative Example 6

The same process was repeated as in Example 1 except that the heat treatment was carried out at 220° C. for 10 seconds to result in a lining cloth.

Comparative Example 7

A grey fabric of a plain weave was woven from warp yarns of polyester filamentary yarn of 50d/24f (of a sheath/core type antistatic fiber) and filling yarns of raw polyester filamentary yarn of 75d/36f (of a circular cross-section), which has a warp density of 120 ends/inch, a filling density of 80 picks/inch, a basis weight of 50 g/m$^2$ and a fabric width of 133 cm. The grey fabric was scoured under the condition described in Table 3. Thereafter, the fabric was preset to have a width of 123 cm (a narrowing ratio of 8%) at 190° C. for 10 seconds. Subsequently, the fabric was dyed by a liquid-stream type dyeing machine under the condition described in Table 1, reduced and rinsed for the purpose of removing excessive dye, and dried. Finally, the fabric was finished under the conditions described in Table 2.

Table 7 shows an elongation, a coefficient of dynamic friction, a crimp index value of the filling yarn (crimp ratio/{warp density×(fineness of warp yarn)$^{1/2}$}, a seam slippage, an appearance, a touch, a bending rigidity, a wear comfort and a wearing pressure of the lining cloths obtained by Examples 1 to 11 and Comparative examples 1 to 7.

TABLE 7

PHYSICAL PROPERTIES OF LINING CLOTH OF PLAIN WEAVE COMPOSED OF FALSE-TWISTED POLYESTER FILAMENTARY FILLING YARNS

| | | Filling wise elongation (%) | Coefficient of dynamic friction | Weave density warp/filling (ends or picks/inch) | Crimp ratio (%) | Crimp Ratio + {(warp density) × (warp end denier)$^{1/2}$} | Bending rigidity (gf·cm$^2$/cm) | Seam slippage (mm) | Wearing pressure (g/cm$^2$) | Wearing comfort | Surface appearance | Fabric touch |
|---|---|---|---|---|---|---|---|---|---|---|---|---|
| Examples | 1 | 5.6 | 0.40 | 104/83 | 5.4 | 0.007 | 0.018 | 0.8 | 34 | ○ | ◎ | ○ |
| | 2 | 10.8 | 0.42 | 110/84 | 10.5 | 0.013 | 0.011 | 0.3 | 30 | ◎ | ○ | ○ |
| | 3 | 5.1 | 0.38 | 127/84 | 5.0 | 0.006 | 0.019 | 0.9 | 35 | ○ | ◎ | ◎ |
| | 4 | 9.5 | 0.38 | 133/84 | 9.0 | 0.009 | 0.012 | 0.5 | 31 | ◎ | ◎ | ◎ |
| | 5 | 8.5 | 0.41 | 131/84 | 8.1 | 0.008 | 0.012 | 0.4 | 31 | ◎ | ◎ | ◎ |
| | 6 | 11.6 | 0.40 | 138/84 | 11.1 | 0.011 | 0.011 | 0.3 | 30 | ○ | ○ | ◎ |
| | 7 | 6.7 | 0.42 | 106/84 | 6.5 | 0.008 | 0.015 | 0.6 | 33 | ◎ | ○ | ○ |
| | 8 | 8.3 | 0.35 | 145/84 | 8.1 | 0.008 | 0.012 | 0.8 | 32 | ◎ | ○ | ○ |
| | 9 | 8.0 | 0.38 | 125/85 | 7.9 | 0.007 | 0.013 | 0.9 | 33 | ○ | ○ | ○ |
| | 10 | 5.2 | 0.37 | 125/84 | 4.9 | 0.004 | 0.021 | 1.0 | 35 | ○ | ◎ | ○ |
| | 11 | 7.9 | 0.39 | 134/84 | 7.3 | 0.006 | 0.012 | 0.5 | 31 | ◎ | ◎ | ○ |
| Comparative Examples | 1 | 21.4 | 0.50 | 128/86 | 21.0 | 0.022 | 0.021 | 0.1 | 27 | x | x crimped surface effect | x harsh x not slipery |
| | 2 | 11.4 | 0.48 | 109/85 | 11.0 | 0.014 | 0.018 | 0.3 | 32 | x | x crimped surface effect | x harsh x not slipery |
| | 3 | 4.2 | 0.39 | 103/84 | 4.0 | 0.005 | 0.028 | 3.7 | 45 | Δ | ○ | ○ |
| | 4 | 9.2 | 0.40 | 132/84 | 8.5 | 0.009 | 0.015 | 0.5 | 31 | Δ | x bowed warp-wise crease | x harsh |
| | 5 | 16.7 | 0.47 | 119/85 | 15.8 | 0.018 | 0.015 | 0 | 27 | x | x crimped surface effect | x harsh not slipery |
| | 6 | 6.0 | 0.41 | 107/84 | 5.8 | 0.007 | 0.028 | 0.7 | 34 | x | ○ | x harsh |
| | 7 | 1.8 | 0.33 | 131/83 | 1.6 | 0.0016 | 0.036 | 7.0 | 51 | x | ○ | x harsh |

As apparent from Table 7, the lining cloths according to the present invention are superior in the seam slippage, excellent in surface smoothness, low in wearing pressure and good in touch compared to Comparative examples.

Examples 12 to 18 and Comparative examples 8 to 11 described below relate to a lining cloth of a twill weave (2/1 twill weave) using a false-twisted polyester filamentary yarn as a filling yarns.

Example 12

A grey fabric of a twill weave was woven from warp yarns of raw polyethylene terephthalate filamentary yarn of 50d/24f and filling yarns of false-twisted polyethylene terephthalate filamentary yarn of a double-heater type of 75d/36f (the number of false-twist of 3350 T/M, a first heater temperature of 220° C., a second heater temperature of 180° C., a feed rate in the second heater zone of +20%), which has a warp density of 150 ends/inch, a filling density of 82 picks/inch, and a fabric width of 132 cm.

The grey fabric was narrowed in width by 12% relative to the as-woven fabric in a pin tenter under the condition of 190° C.×30 seconds. Then, the fabric was scoured in a liquid-stream type dyeing machine with an aqueous solution containing sodium carbonate of 2 g/l and Scourol (marketed by Kao K.K.) of 2 g/l under the condition of 130° C.×10 minutes. Thereafter, the fabric was dyed by a liquid-stream type dyeing machine under the condition described in Table 1, and reduced and rinsed for the purpose of removing an excessive dye to result in a dyed fabric. The dyed fabric was finished under the conditions described in Table 2 to result in a lining cloth.

Example 13

The same process was repeated as in Example 12, except that the warp density was 163 ends/inch and the narrowing ratio was 8%, and a lining cloth was prepared.

Example 14

A grey fabric was woven from the same warp yarns and weft yarns as in Example 12 at a warp density of 125 ends/inch and a filling density of 85 picks/inch to have a twill fabric of 132 cm wide. The grey fabric was narrowed in width and heat-set, scoured, dyed, and finished to be a lining cloth.

Example 15

A grey fabric of a twill weave was woven from warp yarns of raw polyethylene terephthalate filamentary yarn of 75d/24f and filling yarns of false-twisted polyethylene terephthalate filamentary yarn of a single-heater type of 75d/36f (the number of false-twist of 3300 T/M, a heater temperature of 220° C.), which had a warp density of 124 ends/inch, a filling density of 82 picks/inch, and a fabric width of 123 cm.

The grey fabric was narrowed in width by 15% relative to the original width in a pin tenter under the condition of 190° C.×30 seconds. Then, the fabric was scoured in an open soaper type continuous scouring apparatus under the same condition as described in Table 3. Thereafter, the fabric was subjected to a weight reduction treatment with alkali under the same conditions as described in Table 4. The weight reduced fabric was dyed and finished as described in Example 1 to obtain a lining cloth.

Example 16

The same process was repeated as in Example 15, except that the narrowing ratio was 8%, and a lining cloth was prepared.

Example 17

A grey fabric of a twill weave was woven from warp yarns of cupra-ammonium rayon filamentary yarn of 70d/36f and filling yarns of false-twisted polyethylene terephthalate filamentary yarn of a single-heater type of 50d/30f (the number of false-twist of 3300 T/M, a heater temperature of 220° C.), which had a warp density of 170 ends/inch, a filling density of 82 picks/inch, and a fabric width of 132.0 cm.

The grey fabric was narrowed in width by 8% relative to the original width under the condition of 190° C.×30 seconds. Then, the fabric was scoured and desized under the same condition as described in Table 3. Thereafter, the fabric was dyed under the same condition as described in Table 5, and resin-treated under the same conditions as described in Table 6 to result in a lining cloth.

Example 18

A grey fabric of a twill weave was woven from warp yarns of viscose rayon filamentary yarn of 75d/33f and filling yarns of false-twisted polyethylene terephthalate filamentary yarn of a single-heater type of 75d/36f (the number of false-twist of 3300 T/M, a heater temperature of 220° C.), which had a warp density of 135 ends/inch, a filling density of 82 picks/inch, and a fabric width of 132.0 cm.

The grey fabric was narrowed in width by 15% relative to the original width under the condition of 190° C.×30 seconds. Then, the fabric was scoured, desized, dyed and resin-treated under the same condition as described in Example 17 to result in a lining cloth.

Comparative Example 8

The same process was repeated as in Example 1, except that the narrowing heat treatment prior to the scouring in Example 12 was eliminated, to result in a lining cloth having a finished width of 106 cm. This finished width corresponds to a narrowing ratio of 20% relative to the grey fabric.

Comparative Example 9

The grey fabric obtained from Example 12 (of 132 cm wide) was scoured in a liquid-stream type dyeing machine with the same scouring liquid as used in Example 1 under the condition of 130° C.×10 minutes, and narrowed in width at a narrowing ratio of 5% (to be 125 cm) relative to the as-woven fabric by a pin tenter under the condition of 190° C.×30 seconds. Thereafter, the fabric was dyed and finished in the same manner as in Example 12 to result in a lining cloth.

Comparative Example 10

The same process was repeated as in Example 1, except that the narrowing ratio was 3%, to result in a lining cloth.

Comparative Example 11

A grey fabric of a twill weave was woven from warp yarns of polyester filamentary yarn (sheath-core type antistatic yarn) of 50d/24f and filling yarns of raw polyester filamentary yarn of a circular cross-section of 75d/36f, which had a warp density of 150 ends/inch, a filling density of 82 picks/inch, and a fabric width of 133 cm. The grey fabric was scoured under the condition described in Table 3. Thereafter, the resultant fabric was preset at a width of 122 cm (a narrowing ratio of 8%) under the condition of 190° C.×10 seconds and dyed in a liquid-stream type dyeing machine under the condition described in Table 1. Then, the fabric was subjected to a reduction/rinsing treatment for the removal of an excessive dye and dried. Finally, the fabric was finished under the condition described in Table 2 to result in a lining cloth.

Table 8 shows an elongation, a coefficient of dynamic friction, a crimp index value of the filling yarn (crimp ratio/{warp density×(fineness of warp yarn)$^{1/2}$}, a seam slippage, an appearance, a touch, a bending rigidity, a wear comfort and a wearing pressure of the lining cloths obtained from Examples 12 to 18 and Comparative examples 8 to 11.

TABLE 8

PHYSICAL PROPERTIES OF LINING CLOTH OF TWILL WEAVE COMPOSED OF FALSE-TWISTED POLYESTER FILAMENTARY FILLING YARNS

| | | Filling wise elongation (%) | Coefficient of dynamic friction | Weave density warp/filling (ends or picks/inch) | Crimp ratio (%) | Crimp Ratio + {(warp density) × (warp end denier)$^{1/2}$} | Bending rigidity (gf·cm$^2$/cm) | Seam slippage (mm) | Wearing pressure (g/cm$^2$) | Wearing comfort | Surface appearance | Fabric touch |
|---|---|---|---|---|---|---|---|---|---|---|---|---|
| Examples | 12 | 6.6 | 0.34 | 170/83 | 6.5 | 0.005 | 0.023 | 0.8 | 33 | ◎ | ◎ | ○ |
| | 13 | 5.1 | 0.32 | 180/84 | 4.5 | 0.003 | 0.025 | 1.5 | 31 | ○ | ◎ | ○ |
| | 14 | 11.3 | 0.35 | 140/86 | 11.1 | 0.011 | 0.021 | 0.4 | 29 | ○ | ○ | ○ |
| | 15 | 11.5 | 0.37 | 145/84 | 10.9 | 0.009 | 0.020 | 0.3 | 29 | ○ | ○ | ◎ |
| | 16 | 5.3 | 0.25 | 135/84 | 5.1 | 0.004 | 0.022 | 1.0 | 34 | ○ | ◎ | ◎ |
| | 17 | 6.5 | 0.28 | 182/84 | 6.3 | 0.005 | 0.024 | 0.6 | 31 | ◎ | ◎ | ◎ |
| | 18 | 9.8 | 0.27 | 152/84 | 9.5 | 0.007 | 0.022 | 0.5 | 30 | ◎ | ◎ | ◎ |
| Comparative Examples | 8 | 18.5 | 0.43 | 184/86 | 19.0 | 0.014 | 0.015 | 0.3 | 28 | x | x crimped surface | x harsh x not slipery |
| | 9 | 5.4 | 0.42 | 156/85 | 9.8 | 0.009 | 0.019 | 1.1 | 32 | x | x crimped surface | x harsh x not slipery |
| | 10 | 2.5 | 0.28 | 153/84 | 2.1 | 0.002 | 0.035 | 4.5 | 45 | Δ | ◎ Excellent | ○ Good |
| | 11 | 1.8 | 0.27 | 163/84 | 1.7 | 0.001 | 0.036 | 6.2 | 49 | x | ◎ Excellent | ○ Good |

As apparent from Table 8, the lining cloths according to the present invention were superior in the seam slippage, excellent in surface smoothness, low in wearing pressure and good in touch compared to Comparative examples.

Examples 19 to 24 and Comparative examples 12 to 14 described below relate to a lining cloth of a plain weave using raw polyester filamentary yarns as filling yarns.

Example 19

A grey fabric of a plain weave was woven from warp yarns of polyester filamentary yarn (sheath-core type antistatic yarn) of 50d/24f and filling yarns of raw polyester filamentary yarn having a W-shaped cross-section of 50d/30f, which has a warp density of 120 ends/inch, a filling density of 100 picks/inch, and a fabric width of 145.5 cm. The filling yarn of a W-shaped cross-section has a ratio between a longer diameter and a shorter diameter of 3:1.

A crimp ratio of the filling yarn in the grey fabric at this stage was 3.8%. The grey fabric was narrowed in width by 15% relative to the grey fabric in a pin tenter under the condition of 190° C./30 seconds. Then, the fabric was scoured in an open soaper type continuous scouring machine under the condition described in Table 3. Thereafter, the fabric was dyed in a liquid-stream type dyeing machine under the condition described in Table 1, then reduced and rinsed for the purpose of removing excessive dye, and dried. Finally, the fabric was finished under the condition described in Table 2 to result in a lining cloth.

Example 20

A grey fabric of a plain weave was woven from warp yarns of polyester filamentary yarn (of a triangular cross-section) of 50d/36f and filling yarns of polyester filamentary yarn of a W-shaped cross-section of 75d/30f, which has a warp density of 120 ends/inch, a filling density of 82 ends/inch, and a fabric width of 145.5 cm. The filling yarn of a W-shaped cross-section has a ratio between a longer diameter and a shorter diameter of 3:1. A crimp ratio of the filling yarn in the grey fabric at this stage was 1.9%. The grey fabric was narrowed in width by 20% relative to the grey fabric in a pin tenter under the condition of 190° C./30 seconds. Then, the fabric was scoured in an open soaper type continuous scouring machine under the condition described in Table 3. Thereafter, the fabric was treated with alkali under the condition described in Table 4 so that the weight thereof is reduced by 8%, and dyed under the condition described in Table 1. The fabric was reduced and rinsed for the purpose of removing an excessive dye, and dried. Finally, the resultant fabric was finished under the condition described in Table 2 to be a lining cloth.

Example 21

A grey fabric of a plain weave was woven from warp yarns of polyester filamentary yarn (sheath-core type anti-static yarn) of 50d/24f and filling yarns of polyester multi-filamentary yarn of 75d/72f, which had a warp density of 120 ends/inch, a filling density of 82 picks/inch, and a fabric width of 145.5 cm. A crimp ratio of the filling yarn in the grey fabric was 1.6%.

The grey fabric was narrowed in width by 15% relative to the grey fabric under the condition of 190° C./30 seconds. Then, the fabric was scoured in an open soaper type continuous scouring machine under the condition described in Table 3. Thereafter, the fabric was dyed in a liquid-stream type dyeing machine under the condition described in Table 1, then reduced and rinsed for the purpose of removing an excessive dye, and dried. Finally, the resultant fabric was finished under the condition described in Table 2 to be a lining cloth.

Example 22

The same process was repeated as in Example 20, except that the warp density of the grey fabric was 90 ends/inch and the weight reduction treatment with alkali was eliminated to obtain a lining cloth. A crimp ratio of the filling yarn in the grey fabric was 1.7%.

Example 23

A grey fabric of a plain weave was woven from warp yarns of cupra-ammonium rayon filamentary yarn of 50d/30f and filling yarns of polyester filamentary yarn having a W-shaped cross-section of 75d/30f, which had a warp density of 131 ends/inch, a filling density of 82 picks/inch, and a fabric width of 132.0 cm. The filling yarn of a W-shaped dross-section had a ratio between a longer diameter and a shorter diameter of 3:1. A crimp ratio of the filling yarn in the grey fabric was 2.0%.

The grey fabric was narrowed in width by 20% under the condition of 190° C./30 seconds. Then, the fabric was desized and scoured under the condition described in Table 3. Thereafter, the polyester component of the fabric was dyed under the condition described in Table 12. After being reduced and scoured, the cupra-ammonium component was dyed under the condition described in Table 11. Finally, the fabric was resin-treated under the condition described in Table 6 to result in a lining cloth.

Example 24

A grey fabric of a plain weave was woven from warp yarns of cupra-ammonium rayon filamentary yarn of 50d/30f and filling yarns of polyester filamentary yarn having a W-shaped cross-section of 75d/30f, which had a warp density of 145 ends/inch, a filling density of 82 picks/inch, and a fabric width of 132.0 cm. The filling yarn of a W-shaped cross-section had a ratio between a longer diameter and a shorter diameter of 3:1. A crimp ratio of the filling yarn in the grey fabric is 2.2%. The grey fabric was narrowed in width by 20% under the condition of 190° C./30 seconds. Then, the fabric was desized and scoured under the condition described in Table 3, and dyed and resin-treated under the same condition as in Example 23 to result in a lining cloth.

Comparative Example 12

A grey fabric of a plain weave was woven from warp yarns of polyester filamentary yarn (sheath-core type anti-static yarn) of 50d/24f and filling yarns of raw polyester filamentary yarn of a circular cross-section of 75d/36f, which has a warp density of 120 ends/inch, a filling density of 80 picks/inch, and a fabric width of 145.5 cm. A crimp ratio of the filling yarn in the grey fabric was 0.8%.

The grey fabric was narrowed in width by 15% in a pin tenter under the condition of 190° C.×30 seconds and then, the fabric was scoured in a liquid-stream type dyeing machine with an aqueous solution containing sodium carbonate of 2 g/l and Scourol (marketed by Kao K.K.) of 2 g/l under the condition of 130° C.×10 minutes. Thereafter, the fabric was dyed by a liquid-stream type dyeing machine under the condition described in Table 1, and reduced and rinsed for the purpose of removing an excessive dye to result in a dyed fabric. The dyed fabric was finished under the condition described in Table 2 to result in a lining cloth.

Comparative Example 13

The same process was repeated as in Example 20, except that the narrowing ratio was 4% in the heat treatment prior to the scouring, to obtain a lining cloth.

Comparative Example 14

The same process was repeated as in Example 19, except that the narrowing ratio is 35% prior to the scouring, to obtain a lining cloth.

Table 9 shows an elongation, a coefficient of dynamic friction, a crimp index value of the filling yarn (crimp ratio/{warp density×(fineness of warp yarn)$^{1/2}$}, a seam slippage, an appearance, a touch, a bending rigidity, a wear comfort and a wearing pressure of the lining cloths obtained from Examples 19 to 24 and Comparative examples 12 to 14.

TABLE 9

PHYSICAL PROPERTIES OF LINING CLOTH OF PLAIN WEAVE COMPOSED OF RAW POLYESTER FILAMENTARY FILLING YARNS

| | | Filling wise elongation (%) | Coefficient of dynamic friction | Weave density warp/filling (ends or picks/inch) | Crimp ratio (%) | Crimp Ratio + {(warp density) × (warp end denier)$^{1/2}$} | Bending rigidity (gf·cm$^2$/cm) | Seam slippage (mm) | Wearing pressure (g/cm$^2$) | Wearing comfort | Surface appearance | Fabric touch |
|---|---|---|---|---|---|---|---|---|---|---|---|---|
| Examples | 19 | 8.0 | 0.32 | 138/103 | 7.8 | 0.008 | 0.005 | 0.5 | 33 | ◎ | ◎ | ◎ |
| | 20 | 7.5 | 0.31 | 145/84 | 7.3 | 0.007 | 0.011 | 0.7 | 32 | ◎ | ◎ | ◎ |
| | 21 | 5.5 | 0.30 | 139/84 | 5.1 | 0.005 | 0.015 | 0.9 | 35 | ○ | ○ | ○ |
| | 22 | 9.5 | 0.34 | 110/84 | 9.3 | 0.012 | 0.005 | 0.6 | 31 | ◎ | ○ | ○ |
| | 23 | 7.0 | 0.32 | 158/85 | 6.8 | 0.006 | 0.011 | 0.8 | 32 | ◎ | ◎ | ◎ |
| | 24 | 5.6 | 0.31 | 174/84 | 5.4 | 0.004 | 0.011 | 2.5 | 31 | ○ | ◎ | ◎ |
| Comparative Examples | 12 | 2.9 | 0.29 | 138/82 | 2.1 | 0.002 | 0.033 | 7.0 | 45 Rising-up of hem | x | ◎ smooth | Δ harsh |
| | 13 | 2.0 | 0.29 | 125/82 | 1.9 | 0.002 | 0.027 | 5.5 | 51 Rising-up of hem | x | ◎ smooth | Δ harsh |
| | 14 | 10.8 | 0.45 | 152/102 | 10.1 | 0.009 | 0.005 | | Unable to produce because of occurrence of warp-wise crease and weft bow | | | |

As is apparent from Table 9, the lining cloths according to the present invention are superior in the seam slippage, improved in slipperiness due to the lower coefficient of dynamic friction, and soft in touch compared to Comparative examples.

Examples 25 to 31 and Comparative examples 15 to 17 described below relate to a lining cloth of a twill weave (2/1 rising twill weave) using raw polyester filamentary yarns as filling yarns.

Example 25

A grey fabric of a twill weave was woven from warp yarns of polyester filamentary yarn (sheath-core type antistatic yarn) of 50d/24f and filling yarns of polyester multi-filamentary yarn having a W-shaped cross-section of 50d/30f, which had a warp density of 150 ends/inch, a filling density of 100 picks/inch, and a fabric width of 145.5 cm. The filling yarn of a W-shaped cross-section has a ratio between a longer diameter and a shorter diameter of 3:1. A crimp ratio of the filling yarn in the grey fabric was 3.1%.

The grey fabric was narrowed in width by 17% relative to the grey fabric in a pin tenter under the condition of 190° C./30 seconds. Then, the fabric was scoured in an open soaper type continuous scouring apparatus under the condition described in Table 3. Thereafter, the fabric was dyed by a liquid-stream type dyeing machine under the condition described in Table 1. The fabric was reduced and rinsed for the purpose of removing an excessive dye, and dried. The dyed fabric was finished under the conditions described in Table 2 to result in a lining cloth.

Example 26

A grey fabric of a twill weave was woven from warp yarns of polyester filamentary yarn (of a triangular cross-section) of 50d/36f and filling yarns of polyester filamentary yarn having a W-shaped cross-section of 75d/30f, which had a warp density of 150 ends/inch, a filling density of 82 picks/inch, and a fabric width of 145.5 cm. The filling yarn of a W-shaped cross-section had a ratio between a longer diameter and a shorter diameter of 3:1. A crimp ratio of the filling yarn in the grey fabric at this stage was 1.8%.

The grey fabric was narrowed in width by 20% relative to the grey fabric under the condition of 190° C./30 seconds. Then, the fabric was scoured in an open soaper type continuous scouring apparatus under the condition described in Table 3. Thereafter, the fabric was dyed by a liquid-stream type dyeing machine under the condition described in Table 1. The fabric was reduced and rinsed for the purpose of removing an excessive dye, and dried. The dyed fabric was finished under the conditions described in Table 2 to result in a lining cloth.

Example 27

A grey fabric of a twill weave was woven from warp yarns of polyester filamentary yarn (sheath-core type antistatic yarn) of 75d/24f and filling yarns of polyester multi-filamentary yarn of 75d/72f, which has a warp density of 124 ends/inch, a filling density of 82 picks/inch, and a fabric width of 145.5 cm. A crimp ratio of the filling yarn in the grey fabric was 2.0% at this stage.

The grey fabric was narrowed in width by 15% relative to the grey fabric in a pin tenter under the conditions of 190° C./30 seconds. Then, the fabric was scoured in an open soaper type continuous scouring apparatus under the condition described in Table 3. Thereafter, the fabric was dyed by a liquid-stream type dyeing machine under the conditions described in Table 1. The fabric was reduced and rinsed for the purpose of removing an excessive dye, and dried. The dyed fabric was finished under the condition described in Table 2 to result in a lining cloth.

Example 28

The same process was repeated as in Example 25, except that the warp density was 105 ends/inch and the narrowing ratio was 23% in the heat treatment, and a lining cloth was prepared. A crimp ratio of the filling yarn in the grey fabric was 2.8%.

Example 29

A grey fabric of a twill weave was woven from the same yarns as in Example 26, which had a warp density of 160 ends/inch, a filling density of 85 picks/inch, and a fabric width of 132 cm. The grey fabric was narrowed in width, scoured, dyed and finished under the same conditions as in Example 26 to result in a lining cloth. A crimp ratio of the filling yarn in the grey fabric was 1.6%.

Example 30

The desized and scoured fabric obtained from Example 26 was treated with alkali under the same condition as described in Table 4 to reduce the weight thereof by 8%, and thereafter dyed and finished under the same condition as in Example 26.

Example 31

A grey fabric of a twill weave was woven from warp yarns of cupra-ammonium rayon filamentary yarn of 50d/30f and filling yarns of polyester filamentary yarn of 75d/30f having a W-shaped cross-section, which had a warp density of 131 ends/inch, a filling density of 82 picks/inch, and a fabric width of 132.0 cm. The filling yarn of a W-shaped cross-section had a ratio between a longer diameter and a shorter diameter of 3:1. A crimp ratio of the filling yarn in the grey fabric was 1.7%.

The grey fabric was narrowed in width by 20% under the conditions of 190° C./30 seconds. After desized and scoured under the same conditions as described in Table 3, the fabric was dyed and resin-treated under the same conditions as in Example 23 to result in a lining cloth.

Comparative Example 15

A grey fabric of a twill weave was woven from warp yarns of polyester filamentary yarn (sheath-core type antistatic yarn) of 50d/24f and filling yarns of polyester filamentary yarn having a circular cross-section of 75d/36f, which had a warp density of 150 ends/inch, a filling density of 80 picks/inch, and a fabric width of 145.5 cm. A crimp ratio of the filling yarn in the grey fabric was 0.7%.

The grey fabric was narrowed in width by 15% in a pin tenter under the condition of 190° C./30, seconds. Then, the fabric was scoured in a liquid-stream type dyeing machine with an aqueous solution containing sodium carbonate of 2 g/l and Scourol (marketed by Kao K K.) of 2 g/l under the condition of 130° C.×10 minutes. Thereafter, the fabric was dyed by a liquid-stream type dyeing machine under the conditions described in Table 1, and reduced and rinsed for the purpose of removing an excessive dye to result in a dyed fabric. The dyed fabric was finished under the condition described in Table 2 to result in a lining cloth.

Comparative Example 16

The same process was repeated as in Example 2, except that the narrowing ratio prior to the scouring in Example 26 was 4%, and a lining cloth was prepared.

Comparative Example 17

The same process was repeated as in Example 1, except that the narrowing ratio prior to the scouring in Example 25 was 35%, and a lining cloth was prepared.

Table 10 shows an elongation, a coefficient of dynamic friction, a filling yarn crimp index value (crimp ratio/{warp density×(fineness of warp yarn)$^{1/2}$}, a seam slippage, an appearance, a touch, a bending rigidity, a wear comfort and a wearing pressure of the lining cloths obtained from Examples 25 to 31 and Comparative examples 15 to 17.

TABLE 10

PHYSICAL PROPERTIES OF LINING CLOTH OF TWILL WEAVE COMPOSED OF RAW POLYESTER FILAMENTARY FILLING YARNS

| | | Filling wise elongation (%) | Coefficient of dynamic friction | Weave density warp/filling (ends or picks/inch) | Crimp ratio (%) | Crimp Ratio + {(warp density) × (warp end denier)$^{1/2}$} | Bending rigidity (gf·cm$^2$/cm) | Seam slippage (mm) | Wearing pressure (g/cm$^2$) | Wearing comfort | Surface appearance | Fabric touch |
|---|---|---|---|---|---|---|---|---|---|---|---|---|
| Examples | 25 | 6.5 | 0.28 | 178/103 | 6.2 | 0.005 | 0.010 | 0.8 | 33 | ◎ | ◎ | ◎ |
| | 26 | 5.2 | 0.27 | 180/84 | 4.8 | 0.004 | 0.015 | 1.1 | 35 | ○ | ◎ | ○ |
| | 27 | 5.6 | 0.28 | 145/84 | 5.5 | 0.004 | 0.015 | 1.2 | 35 | ○ | ◎ | ○ |
| | 28 | 11.5 | 0.33 | 129/104 | 10.8 | 0.011 | 0.009 | 0.6 | 31 | ◎ | ○ | ◎ |
| | 29 | 6.8 | 0.29 | 193/85 | 6.7 | 0.005 | 0.012 | 0.5 | 33 | ◎ | ◎ | ○ |
| | 30 | 5.5 | 0.27 | 181/84 | 5.4 | 0.004 | 0.008 | 0.8 | 34 | ○ | ◎ | ◎ |
| | 31 | 7.0 | 0.26 | 158/84 | 6.8 | 0.006 | 0.011 | 0.5 | 31 | ◎ | ◎ | ◎ |
| Comparative Examples | 15 | 2.2 | 0.25 | 173/82 | 2.0 | 0.002 | 0.038 | 6.5 | 45 Rising-up of hem | x | ◎ smooth | Δ harsh |
| | 16 | 1.8 | 0.24 | 156/83 | 1.5 | 0.001 | 0.031 | 7.5 | 51 Rising-up of hem | x | ◎ smooth | Δ harsh |
| | 17 | 8.5 | 0.45 | 198/105 | 8.4 | 0.006 | 0.007 | Usable to produce because of occurrence of warp-wise crease and weft bow | | | | |

As is apparent from Table 10, the lining cloths according to the present invention are superior in seam slippage, excellent in surface smoothness, low in wearing pressure and good in touch compared to Comparative examples.

Examples 32 to 40 and Comparative examples 18 and 19 described below relate to a lining cloth of a plain weave using raw cellulosic filamentary yarns as filling yarns.

Example 32

A grey fabric of a plain weave was woven from warp yarns of cupra-ammonium rayon filamentary yarn of 50d/30f and filling yarns of cupra-ammonium filamentary yarn of 75d/45f, which had a warp density of 130 ends/inch, a filling density of 82 picks/inch, and a fabric width of 145 cm.

The grey fabric was dipped in water at 25° C. for about 5 seconds and dehydrated by a dehydrator at a pick-up of 65%. Then, the fabric was continuously subjected to a narrowing heat treatment in a pin tenter at a narrowing ratio of 7% relative to the as-woven fabric under the condition of 190° C./30 seconds. Thereafter, the fabric was scoured by an open soaper type continuous scouring apparatus under the condition described in Table 3, dyed under the condition described in Table 11, and resin-treated under the condition described in Table 6 to result in a lining cloth.

TABLE 11

| | |
|---|---|
| dyeing method | cold pad batch method |
| dye | Sumifix Navy Blue GS of 1% owf |
| auxiliary | Sodium hydroxide of 10 g/l |
| temperature | 25° C. |
| time | 15 hours |

Example 33

A grey fabric of a plain weave was woven from warp yarns of cupra-ammonium rayon filamentary yarn of 75d/45f and filling yarns of cupra-ammonium filamentary yarn of 100d/60f, which had a warp density of 110 ends/inch, a filling density of 70 picks/inch, and a fabric width of 142 cm.

The grey fabric was dipped at 25° C. in water for about 5 seconds and dehydrated by a dehydrator at a pick-up of 65%. Then, the fabric was continuously subjected to a narrowing heat treatment in a pin tenter at a narrowing ratio of 7% relative to the grey fabric under the condition of 190° C./30 seconds. Thereafter, the fabric was scoured, dyed and resin-treated under the same condition as in Example 32 to result in a lining cloth.

Example 34

A grey fabric of a plain weave was woven from warp yarns of polyester filamentary yarn having a triangular cross-section of 50d/36f and filling yarns of cupra-ammonium filamentary yarn of 75d/60f, which has a warp density of 131 picks/inch, a filling density of 82 picks/inch, and a fabric width of 145 cm.

The grey fabric was dipped in water at 25° C. for about 5 seconds and dehydrated by a dehydrator at a pick-up of 50%. Then, the fabric was continuously subjected to a narrowing heat treatment in a pin tenter at a narrowing ratio of 7% relative to the grey fabric under the condition of 200° C./30 seconds. Thereafter, the fabric was scoured in an open soaper type continuous scouring apparatus under the condition described in Table 3. Subsequently, the fabric was dyed under the condition described in Table 5, and resin-treated under the condition described in Table 6 to result in a lining cloth.

Example 35

A grey fabric of a plain weave was woven from warp yarns of viscose rayon filamentary yarn of 50d/20f and filling yarns of viscose rayon filamentary yarn of 75d/33f, which has a warp density of 127 ends/inch, a filling density of 82 picks/inch, and a fabric width of 145 cm.

The grey fabric was dipped in water at 25° C. for about 5 seconds and dehydrated by a dehydrator at a pick-up of 70%. Then, the fabric was continuously subjected to a narrowing heat treatment in a pin tenter at a narrowing ratio of 7% relative to the as-woven fabric under the condition of 190° C./30 seconds. Thereafter, the fabric was scoured in an open soaper type continuous scouring apparatus under the condition described in Table 3. Subsequently, the fabric was dyed under the condition described in Table 11, and resin-treated under the condition described in Table 6 to result in a lining cloth.

Example 36

A grey fabric of a plain weave was woven from warp yarns of viscose rayon filamentary yarn of 75d/33f and filling yarns of viscose rayon filamentary yarn of 100d/44f, which had a warp density of 110 ends/inch, a filling density of 70 picks/inch, and a fabric width of 145 cm.

The grey fabric was dipped in water at 25° C. for about 5 seconds and dehydrated by a dehydrator at a pick-up of 72%. Then, the fabric was continuously subjected to a narrowing heat treatment in a pin tenter at a narrowing ratio of 7% relative to the as-woven fabric under the condition of 150° C./30 seconds. Thereafter, the fabric was scoured, dyed and resin-treated under the same-condition as in Example 35 to result in a lining cloth.

Example 37

A grey fabric of a plain weave was woven from warp and filling yarns of diacetate filamentary yarn of 75d/20f, which had a warp density of 103 ends/inch, a filling density of 80 picks/inch, and a fabric width of 132.0 cm.

The grey fabric was dipped in water at 25° C. for about 5 seconds and dehydrated by a dehydrator at a pick-up of 40%. Then, the fabric was continuously subjected to a narrowing heat treatment in a pin tenter at a narrowing ratio of 7% relative to the as-woven fabric under the condition of 190° C./30 seconds. Thereafter, the fabric was scoured under the condition described in Table 3, dyed under the condition described in Table 12, and finished under the condition described in Table 2 to result in a lining cloth.

TABLE 12

| | |
|---|---|
| dyeing method | jigger dyeing method |
| dye | C.I Disperse Blue 291 of 1% owf |
| auxiliary | Disper TL of 1 g/l |
| temperature | 95° C. |
| time | one hour |

Example 38

The same process was repeated as in Example 32, except that the warp density was 150 ends/inch, to result in a lining cloth.

Example 39

The same process was repeated as in Example 32, except that the narrowing ratio was 12%, to result in a lining cloth.

Example 40

The same process was repeated as in Example 32, except that the narrowing ratio was 5%, to result in a lining cloth.

Comparative Example 18

The grey fabric obtained from Example 32 was narrowed in width by a pin tenter at a narrowing ratio of 7% under the condition of 190° C./30 seconds.

Other conditions-were the same as in Example 32 to result in a lining cloth.

Comparative example 19

The same process as in Example 32 was repeated, except that the narrowing ratio was 4%, to result in a lining cloth.

Comparative Example 20

The same process as in Example 32 was repeated, except that the narrowing ratio was 17%, to result in a lining cloth.

Table 13 shows an elongation, a coefficient of dynamic friction, a filling yarn crimp index value (crimp ratio/{warp density×(warp fineness)$^{1/2}$}, a seam slippage, an appearance, a touch, a bending rigidity, a wear comfort and a wearing pressure of the lining cloths obtained from Examples 32 to 40 and Comparative examples 18 to 20.

TABLE 13

PHYSICAL PROPERTIES OF LINING CLOTH OF PLAIN WEAVE COMPOSED OF CELLULOSIC FILAMENTARY FILLING YARNS

| | | Filling wise elongation (%) | Coefficient of dynamic friction | Weave density warp/filling (ends or picks/inch) | Crimp ratio (%) | Crimp Ratio + {(warp density) × (warp end denier)$^{1/2}$} | Bending rigidity (gf·cm$^2$/cm) | Seam slippage (mm) | Wearing pressure (g/cm$^2$) | Wearing comfort | Surface appearance | Fabric touch |
|---|---|---|---|---|---|---|---|---|---|---|---|---|
| Examples | 32 | 7.8 | 0.23 | 138/83 | 7.5 | 0.007 | 0.026 | 1.0 | 33 | ◎ | ◎ | ◎ |
| | 33 | 7.2 | 0.24 | 118/71 | 7.0 | 0.007 | 0.027 | 0.7 | 33 | ◎ | ◎ | ○ |
| | 34 | 9.0 | 0.29 | 141/84 | 8.7 | 0.008 | 0.027 | 0.9 | 31 | ◎ | ○ | ○ |
| | 35 | 8.0 | 0.31 | 136/85 | 7.7 | 0.008 | 0.028 | 0.8 | 31 | ◎ | ◎ | ◎ |
| | 36 | 7.6 | 0.35 | 118/72 | 7.3 | 0.007 | 0.029 | 0.8 | 32 | ◎ | ◎ | ○ |
| | 37 | 8.5 | 0.37 | 110/82 | 8.3 | 0.008 | 0.025 | 0.6 | 30 | ◎ | ◎ | ○ |
| | 38 | 5.5 | 0.23 | 161/83 | 5.1 | 0.004 | 0.029 | 1.5 | 35 | ○ | ◎ | ○ |
| | 39 | 9.9 | 0.25 | 153/84 | 9.7 | 0.009 | 0.024 | 0.3 | 28 | ◎ | ○ | ◎ |
| | 40 | 5.2 | 0.22 | 135/85 | 4.9 | 0.005 | 0.029 | 1.7 | 36 | ○ | ◎ | ◎ |
| Comparative Examples | 18 | 2.1 | 0.21 | 132/86 | 1.8 | 0.002 | 0.037 | 7.0 | 48 | x | ◎ smooth | Δ fairly harsh |
| | | | | | | | | | Rising-up of hem | | Crease occurred during preparation | |
| | 19 | 4.2 | 0.22 | 134/85 | 3.5 | 0.004 | 0.036 | 5.5 | 45 | x | ◎ smooth | Δ slightly harsh |
| | | | | | | | | | Rising-up of hem | | | |
| | 20 | 10.8 | 0.40 | 146/84 | 10.1 | 0.009 | 0.021 | Usable to mass-produce because of occurrence of warp-wise crease and weft bow, poor quality | | | | |

As apparent from Table 13, the lining cloths according to the present invention are superior in seam slippage, smaller in a coefficient of dynamic friction, and improved in slipperiness compared to Comparative examples. These lining cloths are also excellent in a dimensional stability and a resistance to creases even after being domestically laundered.

Examples 41 to 47 and Comparative examples 21 to 23 described below relate to a lining cloth of a twill weave (2/1 rising twill) using a cellulosic filamentary yarn as a filling yarns.

Example 41

A grey fabric of a twill weave was woven from warp yarns of cupra-ammonium rayon filamentary yarn of 50d/30f and filling yarns of cupra-ammonium filamentary yarn of 75d/45f, which has a warp density of 166 ends/inch, a filling density of 82 picks/inch, and a fabric width of 145 cm.

The grey fabric was dipped in water at 25° C. for about 5 seconds and dehydrated by a dehydrator at a pick-up of 65%. Then, the fabric was continuously subjected to a narrowing heat treatment in a pin tenter at a narrowing ratio of 7% relative to the as-woven fabric under the condition of 190° C./30 seconds.

Thereafter, the fabric was scoured by an open soaper type continuous scouring apparatus under the conditions described in Table 3, dyed under the conditions described in Table 11, and resin-treated under the conditions described in Table 6 to result in a lining cloth.

Example 42

A grey fabric of a twill weave was woven from warp yarns of cupra-ammonium rayon filamentary yarn of 56d/30f and filling yarns of cupra-ammonium filamentary yarn of 75d/45f, which had a warp density of 180 ends/inch, a filling density of 82 picks/inch, and a fabric width of 145 cm.

The grey fabric was dipped in water at 25° C. for about 5 seconds and dehydrated by a dehydrator at a pick-up of 65%. Then, the fabric was continuously subjected to a narrowing heat treatment in a pin tenter at a narrowing ratio of 7% relative to as-woven grey fabric under the condition of 170° C./30 seconds. Thereafter, the fabric was scoured, dyed and resin-treated under the same condition as in Example 41 to result in a lining cloth.

Example 43

A grey fabric of a twill weave was woven from warp yarns of cupra-ammonium rayon filamentary yarn of 75d/45f and filling yarns of cupra-ammonium filamentary yarn of 100d/60f, which had a warp density of 136 ends/inch, a filling density of 70 picks/inch, and a fabric width of 142 cm.

The grey fabric was dipped in water at 25° C. for about 5 seconds and dehydrated by a dehydrator at a pick-up of 65%. Then, the fabric was continuously subjected to a narrowing heat treatment in a pin tenter at a narrowing ratio of 10% relative to the as-woven fabric under the condition of 200° C./30 seconds. Thereafter, the fabric was scoured, dyed and resin-treated under the same condition as in Example 41 to result in a lining cloth.

Example 44

A grey fabric of a twill weave was woven from warp yarns of polyester filamentary yarn (of triangular cross-section) of 50d/36f and filling yarns of cupra-ammonium filamentary yarn of 120d/72f, which has a warp density of 146 ends/inch, a filling density of 65 picks/inch, and a fabric width of 145 cm.

The grey fabric was dipped in water at 25° C. for about 5 seconds and dehydrated by a dehydrator at a pick-up of 52%. Then, the fabric was continuously subjected to a narrowing heat treatment in a pin tenter at a narrowing ratio of 13% relative to the as-woven fabric under the condition of 190° C./30 seconds. Thereafter, the fabric was scoured in an open soaper type continuous scouring apparatus under the condition described in Table 3, dyed under the condition described in Table 5, and resin-treated under the conditions described in Table 6 to result in a lining cloth.

Example 45

A grey fabric of a twill weave was woven from warp yarns of viscose rayon filamentary yarn of 50d/20f and filling yarns of viscose rayon filamentary yarn of 75d/33f, which had a warp density of 120 ends/inch, a filling density of 82 picks/inch, and a fabric width of 145 cm. The grey fabric was dipped in water at 25° C. for about 5 seconds and dehydrated by a dehydrator at a pick-up of 71%. Then, the fabric was continuously subjected to a narrowing heat treatment in a pin tenter at a narrowing ratio of 13% relative to the as-woven fabric under the condition of 190° C./30 seconds. Thereafter, the fabric was scoured, dyed and resin-treated under the same conditions as in Example 41 to result in a lining cloth.

Example 46

A grey fabric of a twill weave was woven from warp yarns of viscose rayon filamentary yarn of 75d/33f and filling yarns of viscose rayon filamentary yarn of 100d/44f, which had a warp density of 136 ends/inch, a filling density of 71 picks/inch, and a fabric width of 145 cm.

The grey fabric was dipped in water at 25° C. for about 5 seconds and dehydrated by a dehydrator at a pick-up of 65%. Then, the fabric was continuously subjected to a narrowing heat treatment in a pin tenter at a narrowing ratio of 7% relative to the as-woven fabric under the condition of 140° C./120 seconds. Thereafter, the fabric was scoured, dyed and resin-treated under the same condition as in Example 45 to result in a lining cloth.

Example 47

The same process was repeated as in Example 41, except that the narrowing ratio was 12% to result in a lining cloth.

Comparative Example 21

The grey fabric obtained from Example 41 was continuously subjected to a narrowing heat treatment in a pin tenter at a narrowing ratio of 7% relative to the as-woven fabric under the condition of 190° C./30 seconds. Other conditions were the same as in Example 41.

Comparative Example 22

The same process was repeated as in Example 41, except that the narrowing ratio was 4% to result in a lining cloth.

Comparative Example 23

The same process was repeated as in Example 41, except that the narrowing ratio was 17% to result in a lining cloth.

Table 14 shows an elongation, a coefficient of dynamic friction, a crimp index value of the filling yarn (crimp ratio/{warp density×(fineness of warp yarn)$^{1/2}$}, a seam slippage, an appearance, a touch, a bonding rigidity, a wear comfort and a wearing pressure of the lining cloths obtained from Examples 41 to 47 and Comparative Examples 21 to 23.

TABLE 14

PHYSICAL PROPERTIES OF LINING CLOTH OF TWILL WEAVE COMPOSED OF CELLULOSIC FILAMENTARY FILLING YARNS

| | | Filling wise elongation (%) | Coefficient of dynamic friction | Weave density warp/filling (ends or picks/inch) | Crimp ratio (%) | Crimp Ratio + {(warp density) × (warp end denier)$^{1/2}$} | Bending rigidity (gf·cm$^2$/cm) | Seam slippage (mm) | Wearing pressure (g/cm$^2$) | Wearing comfort | Surface appearance | Fabric touch |
|---|---|---|---|---|---|---|---|---|---|---|---|---|
| Examples | 41 | 6.5 | 0.23 | 178/85 | 6.2 | 0.005 | 0.026 | 0.8 | 33 | ◎ | ◎ | ◎ |
| | 42 | 5.2 | 0.22 | 193/84 | 4.8 | 0.003 | 0.028 | 1.5 | 35 | ◎ | ◎ | ○ |
| | 43 | 7.9 | 0.25 | 151/72 | 7.6 | 0.006 | 0.024 | 0.7 | 30 | ◎ | ◎ | ◎ |
| | 44 | 9.5 | 0.26 | 165/66 | 9.5 | 0.008 | 0.023 | 0.6 | 31 | ◎ | ◎ | ○ |
| | 45 | 11.4 | 0.28 | 137/85 | 11.1 | 0.011 | 0.023 | 0.5 | 29 | ○ | ○ | ◎ |
| | 46 | 7.1 | 0.26 | 146/72 | 6.9 | 0.005 | 0.027 | 0.8 | 32 | ◎ | ◎ | ○ |
| | 47 | 9.0 | 0.26 | 184/84 | 8.7 | 0.006 | 0.024 | 0.7 | 31 | ◎ | ◎ | ◎ |
| Comparative Examples | 21 | 2.0 | 0.22 | 169/82 | 1.9 | 0.002 | 0.042 | 6.5 | 48 Rising-up of hem | x | ◎ smooth | Δ fairly harsh |
| | 22 | 3.4 | 0.23 | 172/83 | 3.0 | 0.002 | 0.039 | 7.5 | 45 Rising-up hem | x | ◎ smooth | Δ fairly harsh |
| | 23 | 10.1 | 0.31 | 185/84 | 9.4 | 0.007 | 0.020 | | Poorly produced because of occurrence of crease and weft bow, poor quality | | | |

As is apparent from Table 14, the lining cloths according to the present invention are superior in the seam slippage, lower in a coefficient of dynamic friction and excellent in surface slipperiness compared to Comparative Examples.

Examples 48 to 53 described below relate to a lining cloth of a satin weave using a false-twisted polyester filamentary yarn, a raw polyester filamentary yarn and a cellulosic filamentary yarn as a filling yarn. The respective satin were of satin weave of three steps in the warp-wise direction and five steps in the filling-wise direction.

Example 48

A grey fabric of a satin weave was woven from warp yarns of raw polyethylene terephthalate filamentary yarn of 50d/24f and filling yarns of false-twisted polyethylene terephthalate filamentary yarn of a single-heater type of 75d/36f (the number of false-twist of 3300 T/M, a heater temperature of 220° C.), which had a warp density of 250 end/inch, a filling density of 85 picks/inch, and a fabric width of 123.0 cm.

The grey fabric was narrowed in width by 7% relative to the as-woven fabric in a pin tenter under the conditions of 190° C.×30 seconds. Then, the fabric was scoured in an open soaper type continuous scouring apparatus under the conditions described in Table 3.

Thereafter, the fabric was dyed by a liquid-stream type dyeing machine under the condition described in Table 1, reduced and rinsed for the purpose of removing an excessive dye and dried to result in a lining cloth of a satin weave.

Example 49

The same process was repeated as in Example 48, except that the narrowing ratio is 13% to result in a lining cloth.

Example 50

A grey fabric of a satin weave was woven from warp yarns of polyester filamentary yarn (sheath-core type anti-static yarn) of 50d/24f and filling yarns of raw polyester filamentary yarn having a W-shaped cross-section of 50d/30f, which has a warp density of 210 ends/inch, a filling density of 100 picks/inch, and a fabric width of 145 cm. The filling yarn of a W-shaped cross-section has a ratio between a longer diameter and a shorter diameter of 3:1. A crimp ratio of the filling yarn in the grey fabric was 3.6%.

The grey fabric was narrowed in width by 15% relative to the as-woven fabric in a pin tenter under the condition of 190° C./30 seconds. Then, the fabric was scoured in an open soaper type continuous scouring apparatus under the condition described in Table 3. Thereafter, the fabric was dyed in a liquid-stream type dyeing machine under the conditions described in Table 1, then reduced and rinsed for the purpose of removing excessive dye, and dried. Finally, the fabric was finished under the condition described in Table 2 to result in a lining cloth of a satin weave.

Example 51

The same process was repeated as in Example 50, except that the narrowing ratio was 20% to result in a lining cloth.

Example 52

A grey fabric of a satin weave was woven from warp yarns of cupra-ammonium rayon filamentary yarn of 75d/45f and filling yarns of cupra-ammonium rayon filamentary yarn having of 50d/30f, which has a warp density of 160 ends/inch, a filling density of 100 ends/inch, and a fabric width of 142 cm.

The grey fabric was dipped in water at 25° C. for about 5 seconds, dehydrated by a dehydrator at a pick-up 68%, and continuously narrowed in width by 7% relative to the as-woven fabric in a pin tenter under the conditions of 190° C./30 seconds. Then, the fabric was scoured in an open soaper type continuous scouring apparatus under the conditions described in Table 3, and dyed in a liquid-stream type dyeing machine under the condition described in Table 11. Thereafter, the fabric was resin-treated under the condition described in Table 6 to result in a lining cloth of a satin weave.

Example 53

The same process was repeated as in Example 52, except that the narrowing ratio is 13% to result in a lining cloth.

Table 15 shows an elongation, a coefficient of dynamic friction, a crimp index value of the filling yarn (crimp ratio/{warp density×(fineness of warp yarn)$^{1/2}$}, a seam slippage, an appearance, a touch, a bending rigidity, a wear comfort and a wearing pressure of the lining cloths obtained from Examples 48 to 53.

TABLE 15

PHYSICAL PROPERTIES OF LINING CLOTH OF STAIN WEAVE

| | | Filling wise elongation (%) | Coefficient of dynamic friction | Weave density warp/filling (ends or picks/inch) | Crimp ratio (%) | Crimp Ratio + {(warp density) × (warp end denier)$^{1/2}$} | Bending rigidity (gf·cm$^2$/cm) | Seam slippage (mm) | Wearing pressure (g/cm$^2$) | Wearing comfort | Surface appearance | Fabric touch |
|---|---|---|---|---|---|---|---|---|---|---|---|---|
| Examples | 46 | 5.8 | 0.20 | 263/87 | 5.7 | 0.003 | 0.025 | 0.9 | 35 | ◎ | ◎ | ○ |
| | 49 | 9.8 | 0.21 | 283/87 | 9.7 | 0.005 | 0.022 | 0.6 | 31 | ○ | ◎ | ○ |
| | 50 | 6.8 | 0.25 | 242/106 | 6.5 | 0.004 | 0.013 | 0.7 | 32 | ◎ | ◎ | ◎ |
| | 51 | 7.8 | 0.24 | 250/105 | 7.5 | 0.004 | 0.011 | 0.3 | 30 | ◎ | ◎ | ○ |
| | 52 | 6.5 | 0.20 | 170/108 | 6.2 | 0.004 | 0.028 | 0.5 | 29 | ◎ | ◎ | ◎ |
| | 53 | 7.5 | 0.21 | 179/107 | 7.2 | 0.005 | 0.027 | 0.4 | 31 | ◎ | ◎ | ◎ |

As is apparent from Table 15, the lining cloths according to the present invention are superior in seam slippage, lower in a coefficient of dynamic friction and excellent in surface slipperiness compared to Comparative examples.

INDUSTRIAL APPLICABILITY

According to the present invention, an expandable lining cloth is provided from a fabric woven from polyester filamentary yarns, cellulosic filamentary, yarns and the mixture thereof, having an elasticity capable of following up the extension/contraction of the outer cloth of a dress. The lining cloth is also resistant to seam slippage and the riding-up of a skirt, free from wearing pressure, soft in touch, and excellent in slipperiness and wear comfort.

What is claimed is:

1. A lining cloth of a woven fabric in which the warp yarn comprises either polyester filamentary yarn or cellulosic filamentary yarn and the filling yarn comprises a false-twisted polyester filamentary yarn, a raw filamentary yarn or a cellulosic filamentary yarn, characterized in that an elongation in the filling-wise direction of the woven fabric is in a range from 5% to 12%, a coefficient of dynamic friction on the surface of the woven fabric is in a range from 0.20 to 0.45, and a filling-wise crimp index value of the woven fabric as defined by the following formula is in a range from 0.003 to 0.013:

$$\text{Crimp ratio of filling yarn}/\{\text{warp density}\times(\text{warp fineness})^{1/2}\}.$$

2. A lining cloth according to claim 1, characterized in that the woven fabric is of a plain weave, the coefficient of dynamic friction of the surface of the woven fabric is in a range from 0.22 to 0.45, and the value obtained from the formula (1) is in a range from 0.004 to 0.013.

3. A lining cloth according to claim 1, characterized in that the woven fabric is of a twill weave, the coefficient of dynamic friction of the surface of the woven fabric is in a range from 0.20 to 0.38, and the value obtained from the formula (1) is in a range from 0.003 to 0.011.

4. A lining cloth according to claim 1, characterized in that the woven fabric is of a satin weave, the coefficient of dynamic friction of the surface of the woven fabric is in a range from 0.20 to 0.35, and the value obtained from the formula (1) is in a range from 0.003 to 0.009.

5. A lining cloth according to claim 1, characterized in that the filling-wise bending rigidity of the woven fabric is 0.030 $gf\cdot cm^2/cm$ or less.

6. A lining cloth according to claim 1, characterized in that the filling-wise bending rigidity of the woven fabric comprising filling yarn comprising false-twisted polyester filamentary yarns is 0.025 $gf\cdot cm^2/cm$ or less.

7. A lining cloth according to claim 1, characterized in that the filling-wise bending rigidity of the woven fabric composed of the filling yarn comprising raw polyester filamentary yarns is 0.020 $gf\cdot cm^2/cm$ or less.

8. A dress to which the lining cloth according to claim 1 is attached.

9. A method for producing the lining cloth of a woven fabric in which the warp yarn comprises either polyester filamentary yarn or cellulosic filamentary yarn and the filling yarn comprises a raw filamentary yarn, characterized in that an elongation in the filling-wise direction of the woven fabric is in a range of from 5% to 12%, a coefficient of dynamic friction on the surface of the woven fabric is in a range from 0.20 to 0.45, or a filling wise crimp index value of the woven fabric as defined by the following formula is in a range from 0.03 to 0.13

$$\text{Crimp ratio of filling yarn}/\{\text{warp density}\times(\text{warp fineness})^{1/2}\},$$

the process characterized in that grey fabric, composed of the weft yarns comprising a polyester filamentary yarn or cellulosic filamentary yarn and the filling yarns comprising a raw polyester filamentary yarn, the crimp ratio of the filling yarn of 1.5% or more in the grey fabric, is heat treated at a temperature in a range from 160 to 210° C. prior to scouring while being narrowed in width by 5 to 30% relative to the width of the grey fabric.

10. A method for producing the lining cloth of a woven fabric in which the warp yarn comprises either polyester filamentary yarn or cellulosic filamentary yarn and the filling yarn comprises a false-twisted filamentary yarn, characterized in that an elongation in the filling-wise direction of the woven fabric is in a rage from 5% to 12%, a coefficient of dynamic friction on the surface of the woven fabric is in a range from 0.20 to 0.45, and a filling wise crimp index value of the woven fabric as defined by the following formula is in a range from 0.03 to 0.13

$$\text{Crimp ratio of filling yarn}/\{\text{warp density}\times(\text{warp fineness})^{1/2}\},$$

the process characterized in that grey fabric, composed of the warp yarns comprising polyester filamentary yarn and the filling yarns consisting of a false-twisted polyester filamentary yarn is heat treated at a temperature in a range from 160 to 210° C. prior to scouring or after being scoured at a temperature of from 40 to 60° C. while being narrowed in width by 5 to 15% relative to the width of the grey fabric.

11. A method for producing the lining cloth of a woven fabric in which the warp yarn comprises either polyester filamentary yarn or cellulosic filamentary yarn and the filling yarn comprises a cellulosic raw filamentary yarn, characterized in that an elongation in the filling-wise direction of the woven fabric is in a range from 5% to 12%, a coefficient of dynamic friction on the surface of the woven fabric is in a range from 0.20 to 0.45, and a filling wise crimp index value of the woven fabric as defined by the following formula is in a range from 0.03 to 0.013

$$\text{Crimp ratio of filling yarn}/\{\text{warp density}\times(\text{warp fineness})^{1/2}\},$$

the process characterized in that grey fabric, composed of the warp yarns comprising a filamentary polyester yarn or a cellulosic filamentary yarn and the filling yarns comprising a cellulosic filamentary yarn is heat-treated, after being dipped in water, at a temperature in a range from 100 to 210° C. while being narrowed in width by 5 to 15% relative to the width of the grey fabric.

12. A method for producing the lining cloth of a woven fabric in which the warp yarn comprises either polyester filamentary yarn or cellulosic filamentary yarn and the filling yarn comprises a cellulose acetate filamentary yarn, characterized in that an elongation in the filling-wise direction of the woven fabric is in a range from 5% to 12%, a coefficient of dynamic friction on the surface of the woven fabric is in a range from 0.20 to 0.45, and a filling wise crimp index value of the woven fabric as defined by the following formula is in a range from 0.03 to 0.013

$$\text{Crimp ratio of filling yarn}/\{\text{warp density}\times(\text{warp fineness})^{1/2}\},$$

the method characterized in that grey fabric, composed of the warp yarns comprising a filamentary polyester yarn or a cellulosic filamentary yarn and the filling yarns comprising a cellulose acetate filamentary yarn is heat-treated at a temperature in a range from 160 to 210° C. prior to scouring while being narrowed in width by 5 to 15% relative to the width of the grey fabric.

* * * * *